US010607448B2

(12) United States Patent
Nicely et al.

(10) Patent No.: US 10,607,448 B2
(45) **Date of Patent: *Mar. 31, 2020**

(54) GAMING SYSTEM AND METHOD FOR PROVIDING A CASCADING MULTIPLE SIDED SYMBOL GAME

(71) Applicant: IGT, Reno, NV (US)

(72) Inventors: Mark C. Nicely, Daly City, CA (US); Brian F. Saunders, Sunnyvale, CA (US)

(73) Assignee: IGT, Las Vegas, NV (US)

( * ) Notice: Subject to any disclaimer, the term of this patent is extended or adjusted under 35 U.S.C. 154(b) by 1249 days.

This patent is subject to a terminal disclaimer.

(21) Appl. No.: 13/628,912

(22) Filed: Sep. 27, 2012

(65) Prior Publication Data

US 2014/0087827 A1 Mar. 27, 2014

(51) Int. Cl.
*G07F 17/32* (2006.01)
*G07F 17/34* (2006.01)

(52) U.S. Cl.
CPC ..... *G07F 17/3267* (2013.01); *G07F 17/326* (2013.01); *G07F 17/3288* (2013.01); *G07F 17/34* (2013.01)

(58) Field of Classification Search
CPC .... G07F 17/32; G07F 17/326; G07F 17/3267; G07F 17/34
USPC ..... 463/16, 20, 21
See application file for complete search history.

(56) References Cited

U.S. PATENT DOCUMENTS 1,978,395 A 10/1934 Groetchen
3,420,525 A 1/1969 Waders
3,642,287 A 2/1972 Lally et al.
3,735,987 A 5/1973 Ohki
4,099,722 A 7/1978 Rodesch et al.
4,198,052 A 4/1980 Gauselmann
4,200,291 A 4/1980 Hooker
4,326,351 A 4/1982 Heywood et al.
(Continued)

FOREIGN PATENT DOCUMENTS

AU 198774936 6/1987
AU 710015 9/1997
(Continued)

OTHER PUBLICATIONS

Klax Video Game printed from Wikipedia.org on Sep. 27, 2012 (5 pages.) http://en.wikipedia.org/wiki/Klax_(video_game).
(Continued)

*Primary Examiner* — Chase E Leichliter
(74) *Attorney, Agent, or Firm* — Neal, Gerber & Eisenberg LLP

(57) ABSTRACT

A gaming system including a cascading symbol or tumbling reel game which utilizes a plurality of multiple sided symbols or multiple sided game elements. Each multiple sided symbol or multiple sided game element includes a separate or distinct symbol displayed on each of one or more of the sides or faces of that multiple sided symbol. As the gaming system displays such multiple sided symbols at different symbol display positions, the gaming system differs or modifies which sides of which multiple sided symbols are displayed to the player (and thus differs or modifies which separate or distinct symbols of which sides or faces of the multiple sided symbols are displayed to the player).

18 Claims, 19 Drawing Sheets

(56) References Cited

U.S. PATENT DOCUMENTS 4,357,567 A 11/1982 Rock
4,636,951 A 1/1987 Harlick
4,695,053 A 9/1987 Vazquez, Jr. et al.
4,711,451 A 12/1987 Pajak et al.
4,722,527 A 2/1988 Gauselmann
4,790,537 A 12/1988 Smyth et al.
4,826,169 A 5/1989 Bessho et al.
4,874,173 A 10/1989 Kishishita
5,092,598 A 3/1992 Kamille
5,152,529 A 10/1992 Okada
5,205,555 A 4/1993 Hamano
RE34,244 E 5/1993 Hagiwara
5,224,706 A 7/1993 Bridgeman et al.
5,308,062 A 5/1994 Hogan
5,308,065 A 5/1994 Bridgeman et al.
5,332,219 A 7/1994 Marnell, II et al.
5,332,228 A 7/1994 Schultz
5,364,100 A 11/1994 Ludlow et al.
5,393,057 A 2/1995 Marnell, II
5,395,111 A 3/1995 Inoue
5,423,539 A 6/1995 Nagao
5,431,408 A 7/1995 Adams
5,449,173 A 9/1995 Thomas et al.
5,531,440 A 7/1996 Dabrowski et al.
5,564,700 A 10/1996 Celona
5,584,764 A 12/1996 Inoue
5,609,524 A 3/1997 Inoue
5,624,119 A 4/1997 Leake
5,664,998 A 9/1997 Seelig et al.
5,704,835 A 1/1998 Dietz
5,720,662 A 2/1998 Holmes et al.
5,722,891 A 3/1998 Inoue
5,752,881 A 5/1998 Inoue
5,769,716 A * 6/1998 Saffari ..... G07F 17/34
273/143 R
5,772,506 A 6/1998 Marks et al.
5,807,172 A 9/1998 Piechowiak
5,813,911 A 9/1998 Margolin
5,823,873 A 10/1998 Moody
5,833,536 A 11/1998 Davids et al.
5,833,537 A 11/1998 Barrie
5,863,249 A 1/1999 Inoue
5,882,260 A 3/1999 Marks et al.
5,951,397 A 9/1999 Dickinson
5,980,384 A 11/1999 Barrie
5,984,782 A 11/1999 Inoue
5,997,400 A 12/1999 Seelig et al.
5,997,401 A 12/1999 Crawford
6,033,307 A 3/2000 Vancura
6,056,642 A 5/2000 Bennett
6,059,289 A 5/2000 Vancura
6,059,658 A 5/2000 Mangano et al.
6,086,066 A 7/2000 Tekeuchi et al.
6,089,976 A 7/2000 Schneider et al.
6,089,977 A 7/2000 Bennett
6,093,102 A 7/2000 Bennett
6,095,921 A 8/2000 Walker et al.
6,117,013 A 9/2000 Eiba
6,120,031 A 9/2000 Adams
6,120,376 A 9/2000 Bennett
6,120,377 A 9/2000 McGinnis et al.
6,139,124 A 10/2000 Baerlocher et al.
6,142,872 A 11/2000 Walker et al.
6,142,875 A 11/2000 Kodachi et al.
6,149,521 A 11/2000 Sanduski
6,159,095 A 12/2000 Frohm et al.
6,159,096 A 12/2000 Yoseloff
6,159,098 A 12/2000 Slomiany et al.
6,174,235 B1 1/2001 Walker et al.
6,190,254 B1 2/2001 Bennett
6,203,009 B1 3/2001 Sines et al.
6,220,959 B1 4/2001 Holmes, Jr. et al.
6,224,484 B1 5/2001 Okuda et al.
6,227,971 B1 5/2001 Weiss
6,241,607 B1 6/2001 Payne et al.
6,251,013 B1 6/2001 Bennett
6,254,481 B1 7/2001 Jaffe
6,261,177 B1 7/2001 Bennett
6,270,411 B1 8/2001 Gura et al.
6,270,412 B1 8/2001 Crawford et al.
6,290,600 B1 9/2001 Glasson
6,299,165 B1 10/2001 Nagano
6,299,170 B1 10/2001 Yoseloff
6,302,398 B1 10/2001 Vecchio
6,302,429 B1 10/2001 Friedrich
6,305,686 B1 10/2001 Perrie et al.
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,318,721 B1 11/2001 Randall et al.
6,319,124 B1 11/2001 Baerlocher et al.
6,322,078 B1 11/2001 Adams
6,334,814 B1 1/2002 Adams
6,336,860 B1 1/2002 Webb
6,346,043 B1 2/2002 Colin et al.
6,347,996 B1 2/2002 Gilmore et al.
6,358,144 B1 3/2002 Kaddlic et al.
6,394,902 B1 5/2002 Glavich et al.
6,398,644 B1 6/2002 Perrie et al.
6,409,602 B1 6/2002 Wilshire et al.
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,428,412 B1 8/2002 Anderson et al.
6,439,993 B1 8/2002 O'Halloran
6,454,266 B1 9/2002 Breeding et al.
6,464,581 B1 10/2002 Yoseloff et al.
6,481,713 B2 11/2002 Perrie et al.
6,494,454 B2 12/2002 Adams
6,517,432 B1 2/2003 Jaffe
6,517,433 B2 2/2003 Loose et al.
6,554,703 B1 4/2003 Bussick et al.
6,554,704 B2 4/2003 Nicastro et al.
6,561,904 B2 5/2003 Locke et al.
6,565,433 B1 5/2003 Baerlocher et al.
6,575,830 B2 6/2003 Baerlocher et al.
6,585,591 B1 7/2003 Baerlocher et al.
6,589,114 B2 7/2003 Rose
6,604,740 B1 8/2003 Singer et al.
6,616,142 B2 9/2003 Adams
6,632,139 B1 10/2003 Baerlocher
6,632,140 B2 10/2003 Berman et al.
6,634,945 B2 10/2003 Glavich et al.
6,641,477 B1 11/2003 Dietz
6,643,943 B2 11/2003 Dall'Aglio et al.
6,644,663 B2 11/2003 Seelig et al.
6,659,864 B2 12/2003 McGahn et al.
6,666,767 B1 12/2003 Dayan
6,676,511 B2 1/2004 Payne et al.
6,676,512 B2 1/2004 Fong et al.
6,695,696 B1 2/2004 Kaminkow
6,702,671 B2 3/2004 Tarantino
6,712,693 B1 3/2004 Hettinger
6,715,756 B2 4/2004 Inoue
6,719,630 B1 4/2004 Seelig et al.
6,733,386 B2 5/2004 Cuddy et al.
6,746,328 B2 6/2004 Cannon et al.
6,749,502 B2 6/2004 Baerlocher
6,780,109 B2 8/2004 Kaminkow
6,786,818 B1 9/2004 Rothschild et al.
6,802,775 B2 10/2004 Baerlocher et al.
6,805,349 B2 10/2004 Baerlocher et al.
6,805,632 B2 10/2004 Suda
6,808,454 B2 10/2004 Gerrard et al.
6,832,957 B2 12/2004 Falconer
6,837,788 B2 1/2005 Cannon
6,855,054 B2 2/2005 White et al.
6,866,583 B2 3/2005 Glavich et al.
6,875,106 B2 4/2005 Weiss et al.
6,878,061 B2 4/2005 Baerlocher et al.
6,887,157 B2 5/2005 LeMay et al.
6,896,617 B2 5/2005 Daly

(56) References Cited

U.S. PATENT DOCUMENTS 6,905,406 B2 6/2005 Kaminkow et al.
6,910,962 B2 6/2005 Marks et al.
6,913,533 B2 7/2005 Cuddy et al.
6,921,335 B2 7/2005 Rodgers et al.
6,929,952 B2 8/2005 Baerlocher
6,935,950 B2 8/2005 Tarantino
6,939,229 B2 9/2005 McClintic
6,942,571 B1 9/2005 McAllister et al.
6,960,133 B1 11/2005 Marks et al.
6,960,134 B2 11/2005 Hard et al.
6,964,416 B2 11/2005 McClintic et al.
6,971,955 B2 12/2005 Baerlocher et al.
6,979,263 B2 12/2005 Baerlocher et al.
6,981,635 B1 1/2006 Hughs-Baird et al.
6,986,710 B2 1/2006 Baerlocher et al.
6,991,538 B2 1/2006 Cannon
6,997,804 B2 2/2006 Berman
7,001,274 B2 2/2006 Baerlocher et al.
7,014,560 B2 3/2006 Glavich et al.
7,022,016 B2 4/2006 Wood et al.
7,040,983 B2 5/2006 Dolloff et al.
7,048,275 B2 5/2006 Adams
7,052,395 B2 5/2006 Glavich et al.
7,056,209 B2 6/2006 Baerlocher et al.
7,056,213 B2 6/2006 Ching et al.
7,059,967 B2 6/2006 Baerlocher
7,070,502 B1 7/2006 Bussick et al.
7,074,127 B2 7/2006 Cuddy et al.
7,077,745 B2 7/2006 Gomez et al.
7,090,580 B2 8/2006 Rodgers et al.
7,094,148 B2 8/2006 Baerlocher et al.
7,104,886 B2 9/2006 Baerlocher et al.
7,108,602 B2 9/2006 Daly
7,128,646 B2 10/2006 Baerlocher et al.
7,137,888 B2 11/2006 Glavich et al.
7,144,322 B2 12/2006 Gomez et al.
7,153,205 B2 12/2006 Baerlocher
7,160,186 B2 1/2007 Cuddy et al.
7,169,042 B2 1/2007 Muir et al.
7,195,559 B2 3/2007 Gilmore et al.
7,222,858 B2 5/2007 Moody
7,226,359 B2 6/2007 Bussick et al.
7,236,113 B1 6/2007 Wang
7,252,591 B2 8/2007 Van Asdale
7,252,592 B2 8/2007 Rodgers et al.
7,294,055 B2 11/2007 Baerlocher et al.
7,294,058 B1 11/2007 Slomiany et al.
7,309,281 B2 12/2007 Baerlocher et al.
7,309,282 B2 12/2007 Baerlocher et al.
7,331,862 B2 2/2008 Rodgers et al.
7,331,866 B2 2/2008 Rodgers et al.
7,341,512 B2 3/2008 Dolloff et al.
7,357,713 B2 4/2008 Marks et al.
7,371,169 B2 5/2008 Baerlocher
7,371,170 B2 5/2008 Cregan et al.
7,371,172 B2 5/2008 Inoue
7,396,279 B2 7/2008 Berman et al.
7,399,225 B2 7/2008 Kaminkow
7,399,226 B2 7/2008 Mishra
7,402,102 B2 7/2008 Marks et al.
7,442,123 B2 10/2008 Brill et al.
7,448,948 B2 11/2008 Hughs-Baird et al.
7,473,173 B2 1/2009 Peterson et al.
7,494,412 B2 2/2009 Baerlocher
7,494,413 B2 2/2009 Singer et al.
7,510,473 B2 3/2009 Thomas
7,553,231 B2 6/2009 Rodgers et al.
7,611,406 B2 11/2009 Fuller
7,666,085 B2 2/2010 Vorias et al.
8,177,622 B2 * 5/2012 Englman ..... G07F 17/3265 463/16
8,734,222 B2 5/2014 Owen
9,005,022 B2 * 4/2015 Saunders ..... G07F 17/3211 463/16
2001/0016513 A1 8/2001 Muir et al.
2002/0010017 A1 1/2002 Bennett
2002/0025849 A1 2/2002 Olive
2002/0068623 A1 6/2002 Gauselmann
2002/0077165 A1 6/2002 Bansemer et al.
2003/0045345 A1 3/2003 Berman
2003/0045354 A1 3/2003 Giobbi
2003/0054874 A1 3/2003 Kaminkow
2003/0057645 A1 3/2003 Baerlocher et al.
2003/0060267 A1 3/2003 Glavich et al.
2003/0064768 A1 4/2003 Fier
2003/0078089 A1 * 4/2003 Gray ..... G07F 17/3211 463/16
2003/0100356 A1 5/2003 Brown et al.
2003/0157981 A1 8/2003 Marks et al.
2003/0190945 A1 10/2003 Bussick et al.
2003/0203753 A1 10/2003 Muir et al.
2003/0207710 A1 11/2003 Rodgers et al.
2004/0012145 A1 1/2004 Inoue
2004/0014516 A1 1/2004 Inoue
2004/0014517 A1 1/2004 Inoue
2004/0018866 A1 1/2004 Inoue
2004/0026854 A1 2/2004 Inoue
2004/0033827 A1 2/2004 Gilmore et al.
2004/0033829 A1 * 2/2004 Pacey ..... G07F 17/3265 463/20
2004/0036218 A1 2/2004 Inoue
2004/0038726 A1 2/2004 Inoue
2004/0043809 A1 3/2004 Gomez et al.
2004/0048651 A1 3/2004 Vorias et al.
2004/0053669 A1 3/2004 Gerrard et al.
2004/0053672 A1 3/2004 Baerlocher
2004/0053676 A1 3/2004 Rodgers
2004/0067790 A1 4/2004 Peterson et al.
2004/0072612 A1 4/2004 Rodgers et al.
2004/0097280 A1 5/2004 Gauselmann
2004/0102236 A1 5/2004 Suda et al.
2004/0102244 A1 5/2004 Kryuchkov et al.
2004/0102245 A1 5/2004 Escalera et al.
2004/0137982 A1 7/2004 Cuddy et al.
2004/0147306 A1 7/2004 Randall et al.
2005/0020344 A1 1/2005 Kaminkow
2005/0049035 A1 3/2005 Baerlocher et al.
2005/0054429 A1 3/2005 Baerlocher et al.
2005/0059446 A1 3/2005 Kaminkow
2005/0064924 A1 3/2005 Glavich et al.
2005/0070354 A1 3/2005 Baerlocher et al.
2005/0101380 A1 5/2005 Glavich et al.
2005/0119403 A1 6/2005 St. Clair
2005/0148381 A1 7/2005 Marks et al.
2005/0148384 A1 7/2005 Marks et al.
2005/0227754 A1 10/2005 Kaminkow et al.
2005/0245307 A1 11/2005 Gatto et al.
2005/0282620 A1 12/2005 Marks et al.
2005/0288094 A1 12/2005 Marks et al.
2006/0030392 A1 2/2006 Rodgers et al.
2006/0046830 A1 3/2006 Webb
2006/0058097 A1 3/2006 Berman et al.
2006/0068875 A1 3/2006 Cregan et al.
2006/0068882 A1 3/2006 Baerlocher et al.
2006/0068884 A1 3/2006 Baerlocher et al.
2006/0068885 A1 3/2006 Cregan et al.
2006/0073876 A1 4/2006 Cuddy
2006/0073879 A1 4/2006 Baerlocher
2006/0084492 A1 4/2006 Baerlocher et al.
2006/0084494 A1 4/2006 Belger et al.
2006/0084498 A1 4/2006 Baerlocher et al.
2006/0089191 A1 4/2006 Singer et al.
2006/0116195 A1 6/2006 Baerlocher et al.
2006/0172795 A1 8/2006 Bussick et al.
2006/0199636 A1 9/2006 Ching et al.
2006/0199637 A1 9/2006 Ching et al.
2006/0217189 A1 9/2006 Walker et al.
2006/0264254 A1 11/2006 Aoki
2007/0010316 A1 1/2007 Baerlocher et al.
2007/0021176 A1 1/2007 Jackson
2007/0021188 A1 1/2007 Rodgers et al.
2007/0060246 A1 3/2007 Baerlocher et al.
2007/0060248 A1 3/2007 Rodgers et al.
2007/0060294 A1 3/2007 Cuddy et al.

(56) References Cited

U.S. PATENT DOCUMENTS

| | | | | |
|---|---|---|---|---|
| 2007/0087812 | A1 | 4/2007 | Glavich et al. | |
| 2007/0287523 | A1 | 12/2007 | Esses et al. | |
| 2008/0051174 | A1 | 2/2008 | Fiden | |
| 2008/0090655 | A1* | 4/2008 | Marks | G07F 17/3265 463/29 |
| 2008/0096670 | A1 | 4/2008 | Baerlocher et al. | |
| 2008/0102931 | A1 | 5/2008 | Marks et al. | |
| 2008/0108411 | A1 | 5/2008 | Jensen et al. | |
| 2008/0113765 | A1 | 5/2008 | DeWall | |
| 2008/0125212 | A1* | 5/2008 | Schofield | G07F 17/3213 463/20 |
| 2008/0132320 | A1 | 6/2008 | Rodgers | |
| 2008/0139298 | A1 | 6/2008 | Rodgers et al. | |
| 2008/0182647 | A1* | 7/2008 | Brunet De Courssou | G07F 17/3211 463/20 |
| 2008/0200232 | A1 | 8/2008 | Baerlocher et al. | |
| 2008/0200238 | A1 | 8/2008 | Mishra | |
| 2008/0214282 | A1 | 9/2008 | Inoue | |
| 2008/0234032 | A1 | 9/2008 | Mullahkhel et al. | |
| 2009/0069071 | A1* | 3/2009 | Aoki | G07F 17/34 463/20 |
| 2009/0118004 | A1 | 5/2009 | Hoffman | |
| 2009/0124325 | A1 | 5/2009 | Wadleigh et al. | |
| 2009/0124347 | A1 | 5/2009 | Rodgers et al. | |
| 2009/0137309 | A1* | 5/2009 | Thomas | G07F 17/3211 463/20 |
| 2009/0186684 | A1* | 7/2009 | Visser | G07F 17/3267 463/20 |
| 2009/0227357 | A1* | 9/2009 | Rasmussen | G07F 17/32 463/21 |
| 2010/0004050 | A1 | 1/2010 | Caputo et al. | |
| 2010/0004056 | A1 | 1/2010 | Walker et al. | |
| 2010/0022297 | A1 | 1/2010 | Saunders | |
| 2010/0029364 | A1 | 2/2010 | Zielinski | |
| 2010/0120507 | A1 | 5/2010 | Rodgers et al. | |
| 2010/0124972 | A1 | 5/2010 | Rodgers et al. | |
| 2010/0130280 | A1 | 5/2010 | Arezina et al. | |
| 2011/0053675 | A1 | 3/2011 | Aoki et al. | |
| 2011/0086695 | A1 | 4/2011 | Evans | |
| 2011/0111825 | A1 | 5/2011 | Caputo | |
| 2011/0117989 | A1 | 5/2011 | Kennedy et al. | |
| 2012/0115606 | A1* | 5/2012 | Seelig | G07F 17/3213 463/32 |
| 2013/0035151 | A1* | 2/2013 | Owen | G07F 17/3244 463/20 |
| 2013/0102377 | A1* | 4/2013 | Ballone | G07F 17/3288 463/21 |

FOREIGN PATENT DOCUMENTS

| | | |
|---|---|---|
| AU | 722969 | 6/1998 |
| AU | 199917318 | 9/1999 |
| AU | 200069612 | 2/2001 |
| AU | 2001256012 | 12/2001 |
| AU | 2001256014 | 12/2001 |
| EP | 0058488 | 8/1982 |
| EP | 0060019 | 9/1982 |
| EP | 0410789 | 1/1991 |
| EP | 0874337 | 10/1998 |
| EP | 0981119 | 2/2000 |
| EP | 0984408 | 3/2000 |
| EP | 1039424 | 9/2000 |
| EP | 1063622 | 12/2000 |
| EP | 1150261 | 10/2001 |
| EP | 1184822 | 3/2002 |
| EP | 1197932 | 4/2002 |
| EP | 1205894 | 5/2002 |
| EP | 1422673 | 5/2004 |
| EP | 1513117 | 3/2005 |
| GB | 1454046 | 10/1976 |
| GB | 2062922 | 5/1981 |
| GB | 2106293 | 9/1981 |
| GB | 2081952 | 2/1982 |
| GB | 2090690 | 7/1982 |
| GB | 2096376 | 10/1982 |
| GB | 2097160 | 10/1982 |
| GB | 2100905 | 1/1983 |
| GB | 2105891 | 3/1983 |
| GB | 2106295 | 4/1983 |
| GB | 2113881 | 8/1983 |
| GB | 2117155 | 10/1983 |
| GB | 2137392 | 10/1984 |
| GB | 2161008 | 1/1986 |
| GB | 2165385 | 4/1986 |
| GB | 2170643 | 8/1986 |
| GB | 2180087 | 3/1987 |
| GB | 2181589 | 4/1987 |
| GB | 2183882 | 6/1987 |
| GB | 2191030 | 12/1987 |
| GB | 2222712 | 3/1990 |
| GB | 2225889 | 6/1990 |
| GB | 2226436 | 6/1990 |
| GB | 2242300 | 9/1991 |
| GB | 2262642 | 6/1993 |
| GB | 2322217 | 8/1998 |
| GB | 2335524 | 9/1999 |
| GB | 2372132 | 2/2001 |
| GB | 2393555 | 3/2004 |
| WO | WO9732285 | 9/1997 |
| WO | WO9820949 | 5/1998 |
| WO | WO0030727 | 6/2000 |
| WO | WO0032286 | 6/2000 |
| WO | WO0066235 | 11/2000 |
| WO | WO0076606 | 12/2000 |
| WO | WO0126019 | 4/2001 |
| WO | 200139027 | 10/2001 |
| WO | WO03026756 | 4/2003 |
| WO | WO04025584 | 3/2004 |
| WO | WO05028043 | 3/2005 |
| WO | WO06076294 | 7/2006 |
| WO | WO07002935 | 1/2007 |
| WO | WO07084766 | 7/2007 |
| WO | WO07130443 | 11/2007 |
| WO | WO07130444 | 11/2007 |

OTHER PUBLICATIONS http:www.abadnonia.com/en/games/490/Klax.html (3 pages.) Printed Sep. 27, 2012.

Classsic Retro Games—Retro Gamer Magazine, Klax Video Game profile printed Sep. 27, 2012 (2 pages.) http://retrogamer.net/show_image.php?imageID=992.

* cited by examiner

GAMING SYSTEM AND METHOD FOR PROVIDING A CASCADING MULTIPLE SIDED SYMBOL GAME

CROSS REFERENCE TO RELATED APPLICATIONS

This application relates to the following co-pending commonly owned patent applications: "GAMING SYSTEM AND METHOD FOR PROVIDING A CASCADING MULTIPLE SIDED SYMBOL GAME," Ser. No. 13/628,873.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur provide higher awards. In such known gaming machines, the amount of the wager made on the base game by the player can vary.

Gaming machines which provide cascading symbol or tumbling reel games are also known. In one such cascading symbol or tumbling reel game, a gaming machine generates and displays a plurality of symbols in a symbol display position matrix or grid. This symbol display position matrix includes a plurality of symbol display positions. Each symbol display position is associated with a specific row and a specific column of the symbol display position matrix. In such a cascading symbol game, the gaming machine evaluates the displayed symbols and provides an award for each winning symbol combination formed. The gaming machine then removes the displayed symbols that form any winning symbol combination to create one or more empty symbol display positions. The gaming machine shifts zero, one, or more of the remaining displayed symbols downward into zero, one, or more of the created empty symbol display positions. If any empty symbol display positions remain, the gaming machine generates and displays a symbol for each remaining empty symbol display position. The gaming machine then evaluates the displayed symbols and provides any award for any winning symbol combinations formed. If winning symbol combinations continue to be formed, the gaming machine repeats the steps of removing generated symbols, shifting generated symbols, generating new symbols, and evaluating generated symbols until no winning symbol combinations remain.

There is a continuing need to increase the level of excitement and entertainment for people playing gaming machines. There is also need for new ways of providing better gaming experiences and environments at gaming machines. For example, in certain tumbling reel games, it can take an appreciable amount of time from the start of showing a winning outcome until the winning symbols are fully removed. This gives the player a designated amount of time to evaluate the surrounding symbols in terms of post-tumble winning possibilities. Certain players often can tell they have no winning symbol combinations and thus their only chance of a win is for any newly generated symbols to have a partial or full match. Accordingly, there is a need for improving player anticipation between tumbles. There is a further need for increasing the number of winning symbol combinations generated and awards provided to a player for a single wager on a play of a game.

SUMMARY

The present disclosure relates generally to gaming systems and methods for providing a cascading multiple sided symbol game.

In various embodiments, the gaming system disclosed herein includes a cascading symbol or tumbling reel game which utilizes a plurality of multiple sided symbols or multiple sided game elements. Each multiple sided symbol or multiple sided game element includes a separate or distinct symbol displayed on each of one or more of the sides or faces of that multiple sided symbol. As the gaming system displays such multiple sided symbols at different symbol display positions, the gaming system differs or modifies which sides of which multiple sided symbols are displayed to the player (and thus differs or modifies which separate or distinct symbols of which sides or faces of the multiple sided symbols are displayed to the player).

In different embodiments, in association with: (i) an initial generation of one or more multiple sided symbols, (ii) a shifting of one or more previously generated multiple sided symbols (following the removal of one or more generated symbols) and/or (iii) a subsequent generation of one or more multiple sided symbols (following any shifting of any previously generated symbols), the gaming system alternates which symbol on which side or face of one or more multiple sided symbols is displayed to the player. In these embodiments, in conjunction with the generation of one or more symbols and/or the shifting of one or more previously generated symbols, the gaming system rotates such multiple sided symbols to display the different distinct symbols on the different sides of such multiple sided symbols.

Put differently, in one embodiment, as a multiple sided symbol cascades or tumbles from at least a first symbol display position to at least a second symbol display position, the gaming system flips or rotates the multiple sided symbol such that the symbol on a first side of the multiple sided symbol is displayed to the player in association with the first symbol display position and the symbol on a second, different side of the multiple sided symbol is displayed to the player in association with the second symbol display position. For example, if a column of a symbol display position matrix include three symbol display positions, for a first multiple sided symbol generated in association with that column, the gaming system displays: (i) a symbol of a first side of that multiple sided symbol when that multiple sided symbol is positioned in a first or top symbol display position of the column, (ii) a symbol of a second side of that multiple sided symbol when that multiple sided symbol is positioned in a second or middle symbol display position of the column (i.e., the multiple sided symbol flipped), and (iii) the symbol of the first side of that multiple sided symbol when that multiple sided symbol is positioned in a third or bottom symbol display position of the column (i.e., the multiple sided symbol flipped again). Moreover, in another embodiment, as a multiple dimension symbol (i.e., a three dimensional shape with individually symbols on each side or face of the three dimensional shape) cascades or tumbles from at least a first symbol display position to at least a second symbol display position, the gaming system flips or rotates the multiple dimension symbol such that the symbol on one of: (i) a first side of the multiple dimension symbol, (ii) a second side of the multiple dimension symbol, or (iii) a third side of the multiple dimension symbol, is displayed to the player in association with the first symbol display position and the symbol on another one of: (i) the first side of the multiple dimension symbol, (ii) the second side of the multiple dimension symbol, or (iii) the third side of the multiple dimension symbol, is displayed to the player in association with the second symbol display position.

It should be appreciated that in these embodiments, which symbol of which side of a multiple sided symbol the gaming system displays to the player (and thus which displayed symbol the gaming system evaluates for any awards) is based on: (i) which symbol of which side of the multiple sided symbol the gaming system initially displayed to the player, and (ii) the quantity of rotations or flips of that multiple sided symbol. For example, if the gaming system initially displays a first symbol on a first side of a multiple sided symbol and the gaming system proceeds to flip or rotate that multiple sided symbol a first, odd number or quantity of times, after such flipping of the multiple sided symbol, the gaming systems displays a second, different symbol on a second, different side of the multiple sided symbol. On the other hand, in this example, if the gaming system initially displays the first symbol on the first side of the multiple sided symbol and the gaming system proceeds to flip or rotate that multiple sided symbol a second, even number or quantity of times, after such flipping of the multiple sided symbol, the gaming systems displays the first symbol on the first side of the multiple sided symbol. Such a configuration provides an increased amount of excitement and enjoyment for certain players as such players enjoy the anticipation associated with not knowing which side of a multiple sided symbol will be utilized to determine any awards provided to the player.

More specifically, in one embodiment, the gaming system generates one of a plurality of different symbols at each of a plurality of symbol display positions, wherein: (i) the plurality of symbol display positions form at least three columns and at least three rows including a first row, a second row positioned adjacent to the first row and a third row positioned adjacent to the second row, and (ii) at least one of the symbols is a multiple sided symbol with a distinct symbol on each of a plurality of sides of the multiple sided symbol. In this embodiment, the gaming system displays the generated symbols (wherein for each generated multiple sided symbol, the distinct symbol of a first side of the generated multiple sided symbol is displayed) and determines if any of the displayed symbols form any winning symbol combinations. If a plurality of the displayed symbols form at least one winning symbol combination, the gaming system of this embodiment displays an award for each displayed winning symbol combination, removes at least one displayed symbol from at least one displayed winning symbol combination, and for each of any symbols removed from the first row of the symbol display positions: repositions at least one of the displayed symbols to another one of the symbol display positions to create at least one empty symbol display position, and for at least one repositioned multiple sided symbol, rotates the repositioned multiple sided symbol at least once to display one of: the distinct symbol of the first side of the multiple sided symbol and the distinct symbol of a second side of the multiple sided symbol. For each of any symbols removed from the second row of the symbol display positions, the gaming system of this embodiment repositions at least one of the displayed symbols to another one of the symbol display positions to create at least one empty symbol display position, and for at least one repositioned multiple sided symbol, rotates the repositioned multiple sided symbol at least once to display one of: the distinct symbol of the first side of the multiple sided symbol and the distinct symbol of a second side of the multiple sided symbol. The gaming system of this embodiment displays one of the plurality of symbols for each created empty symbol display position and repeats this process until no winning symbol combinations are displayed. Such a configuration provides the player one or more additional award opportunities in association with one play of a game.

Accordingly, certain embodiments of the gaming system disclosed herein provide that which symbol of which side or face of a multiple sided symbol the gaming system evaluates for any associated awards is based on one or more rotations of such a multiple sided symbol. As certain players are unsure of which side a multiple sided symbol will stop rotating at, such a configuration provides an increased level of excitement and enjoyment for these players.

Additional features and advantages are described in, and will be apparent from, the following Detailed Description and the figures.

DETAILED DESCRIPTION

Cascading Multiple Sided Symbol Game

In various embodiments, the gaming system disclosed herein includes a cascading symbol or tumbling reel game which utilizes a plurality of multiple sided symbols or multiple sided game elements. Each multiple sided symbol includes a symbol displayed on one or more sides or faces of the multiple sided symbol. In these embodiments, as the gaming system shifts one or more multiple sided symbols into one or more of empty symbol display positions (in association with an initial generation of such multiple sided symbols and/or in association with the removal and replacement of one or more generated symbols), the gaming system alternates which side of each multiple sided symbol is displayed to the player. That is, as a multiple sided symbol cascades or tumbles from at least a first symbol display position of one of a plurality of reels to at least a second symbol display position of that reel, the gaming system flips or rotates the multiple sided symbol such that the symbol on a first side of the multiple sided symbol is displayed to the player in association with the first symbol display position and the symbol on a second, different side of the multiple sided symbol is displayed to the player in association with the second symbol display position. Accordingly, which symbol of which side of a multiple sided symbol the gaming system displays to the player (and thus the gaming system evaluates for any awards) is based on: (i) which symbol of which side of the multiple sided symbol the gaming system initially displayed to the player, and (ii) the quantity of rotations or flips of that multiple sided symbol.

While certain of the embodiments described below are directed to playing the cascading multiple sided symbol game as a primary or base game, it should be appreciated that the present disclosure may additionally or alternatively be employed as a secondary or bonus game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
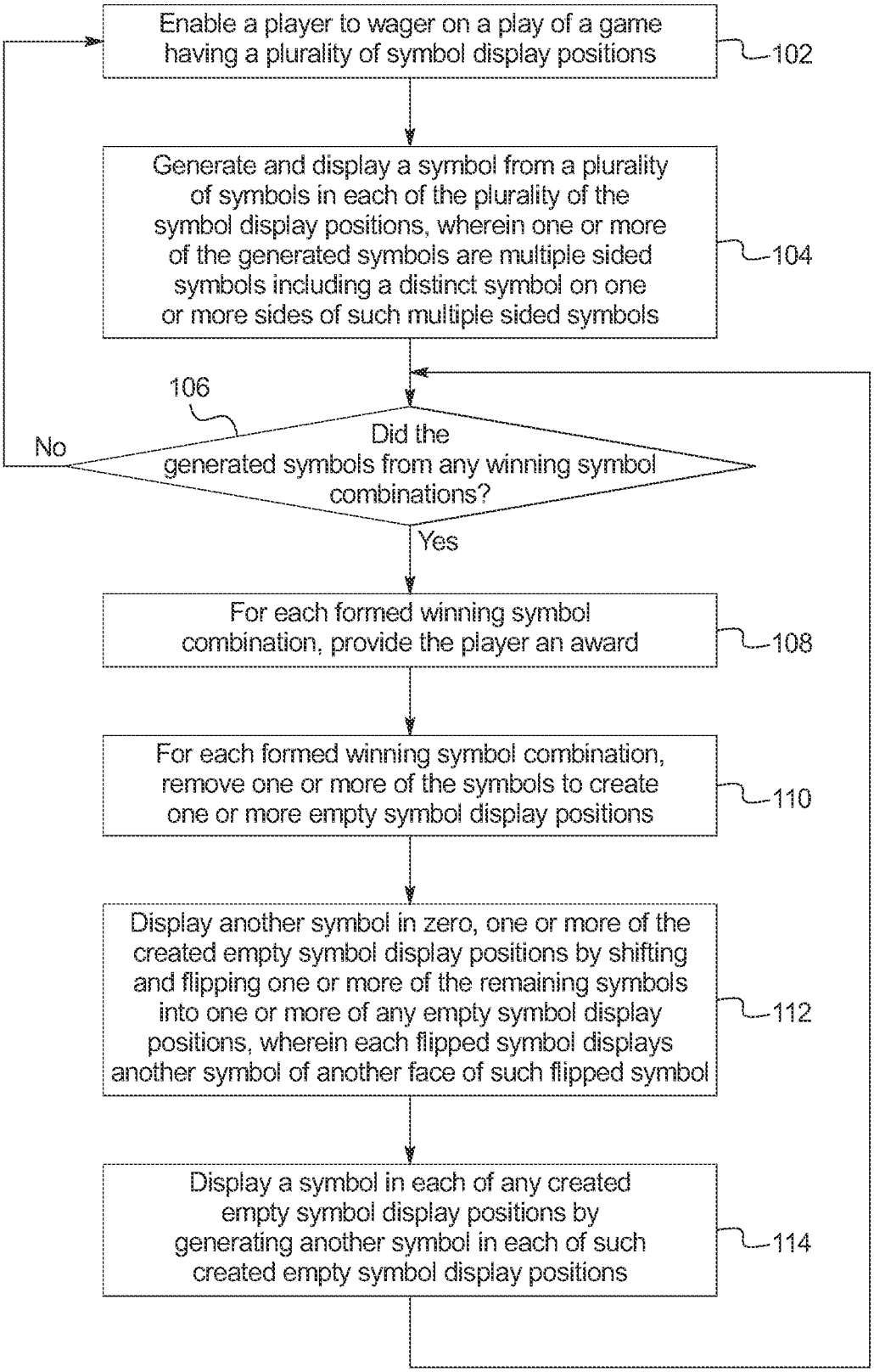
FIG. 1 is a flow chart an example process for operating a gaming system providing one embodiment of a cascading symbol game which employs multiple sided symbols disclosed herein.

Referring now to FIG. 1, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In one embodiment, as indicated in block 102, the gaming system enables a player to wager on a play of a game having a plurality of symbol display positions. In one embodiment, the symbol display positions form a single symbol display position matrix or grid. In another embodiment, the symbol display positions form a plurality of linked (or partially linked) symbol display position matrixes or grids. In different embodiments, one or more symbol display position grids are arranged in a plurality of rows and a plurality of columns or arranged in any suitable configuration to form any suitable shape.

For a wagered on play of the game, as indicated in block 104, the gaming system generates and displays a symbol from a plurality of symbols in each of the plurality of symbol display positions. As further indicated in block 104, one or more of the generated symbols are multiple sided symbols or multiple sided game elements including a distinct symbol on one or more sides of such multiple sided symbols.

In one embodiment, one or more of the generated symbols are multiple sided symbols or multiple sided game elements including a length component and a width component. In this embodiment, each face or side of such multiple sided symbols include zero, one or more distinct symbols, such as a two dimensional tile with a distinct symbol displayed on each face or side of the tile. In another embodiment, one or more of the generated symbols are multiple dimension multiple sided symbols or game elements including a length component, a width component and a depth component. For example, one or more multiple dimension multiple sided symbols each include a six-sided or hexagonal shape with individually displayed symbols on each side or face of the multi-dimensional shape. In another example, one or more multiple dimension multiple sided symbols each include a four-sided square or rectangular shape with individually displayed symbols on each side or face of the multi-dimensional shape. In another example, one or more multiple dimension multiple sided symbols each include a three-sided or triangular shape with individually displayed symbols on each side or face of the multi-dimensional shape. It should be appreciated that such multiple dimension symbols can include any suitable number of sides and any suitable number of individually displayed symbols per side.

In certain embodiments, the gaming system displays the generation of the symbols as a cascading or falling symbol game. In one such embodiment, the gaming system displays the initial generation of the symbols as a cascading or falling symbol game wherein as one or more of the generated multiple sided symbols move or shift in a suitable direction to an open or empty symbol display position, the gaming system displays such multiple sided symbols flipping or rotating between the different sides of such multiple sided symbols. For example, as seen in FIGS. 2A to 2I, in association with generating a plurality of multiple sided symbols or multiple sided game elements 150 at a plurality of symbol display positions 152 of a symbol display position grid, the gaming system flips or rotates the generated multiple sided symbols as such multiple sided symbols move between symbol display positions. That is, in association with initially tumbling the multiple sided symbols down into the symbol display positions of the symbol display position grid, the gaming system flips or rotates such tumbling symbols.

Figure 2A:
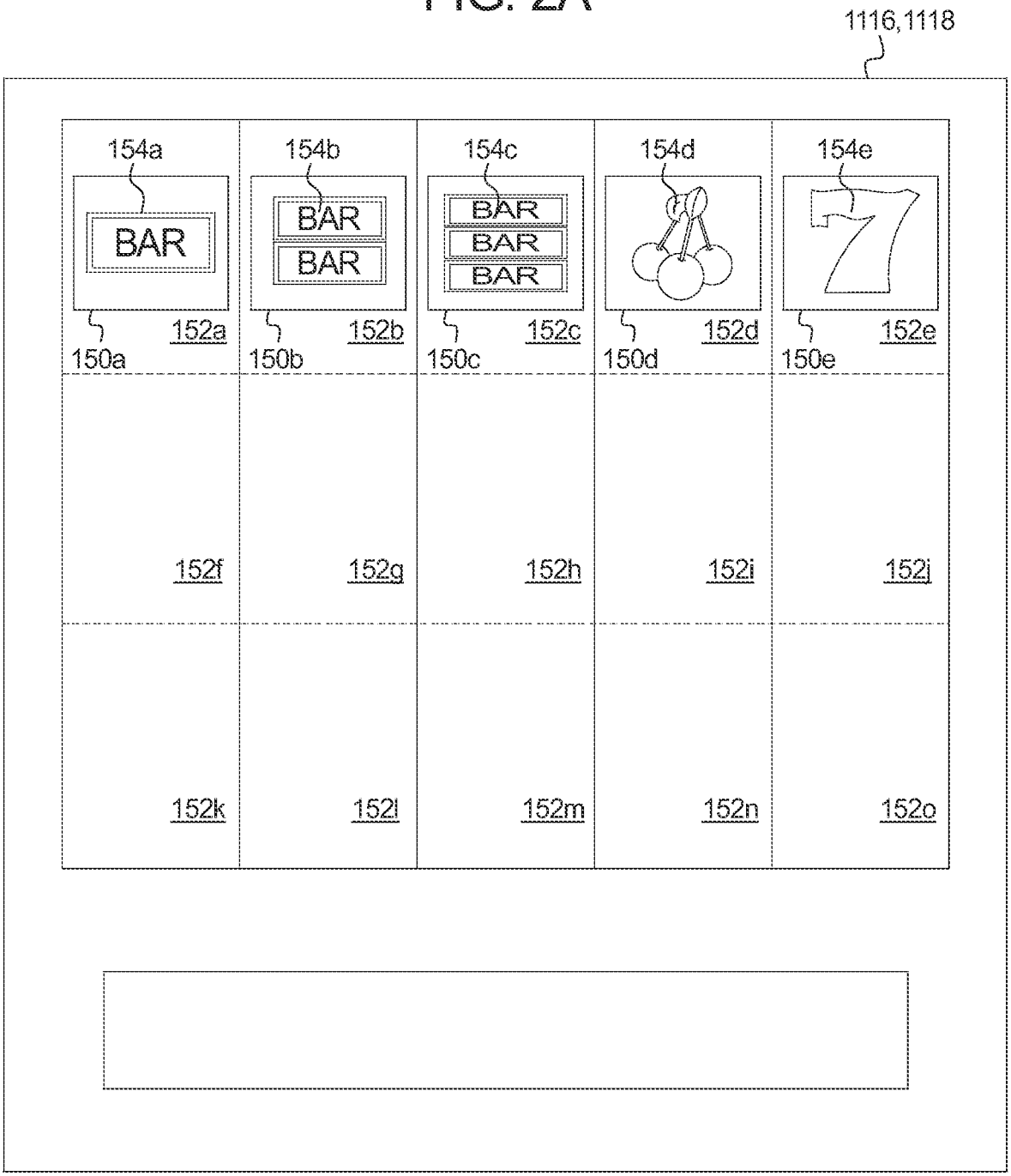
FIGS. 2A, 2B, 2C, 2D, 2E, 2F, 2G, 2H, 2I, 2J, 2K, 2L, 2M and 2N are front views of one embodiment of the gaming system disclosed herein illustrating a play of a cascading symbol game which employs multiple sided symbols.
Figure 2B:
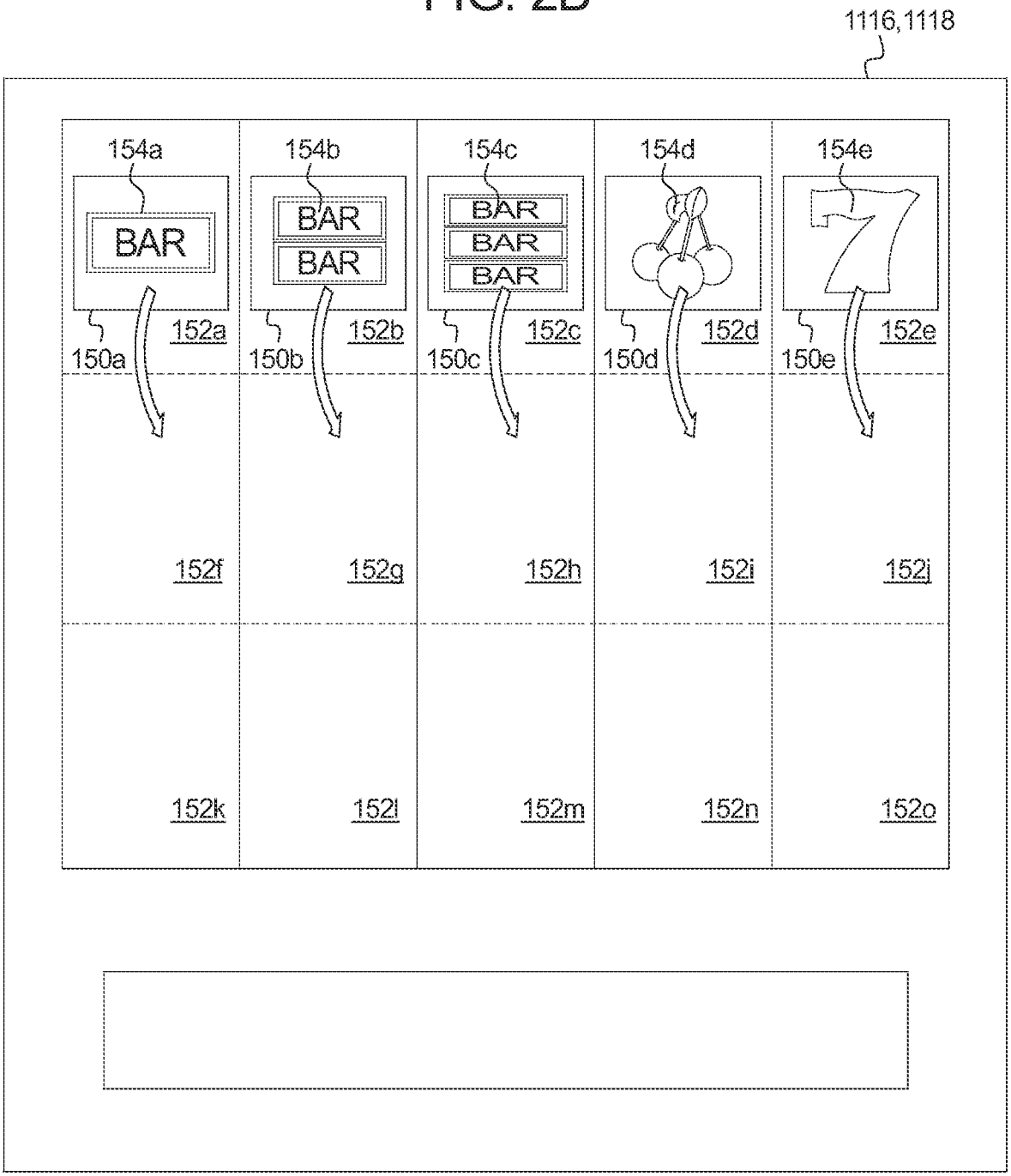
Figure 2C:
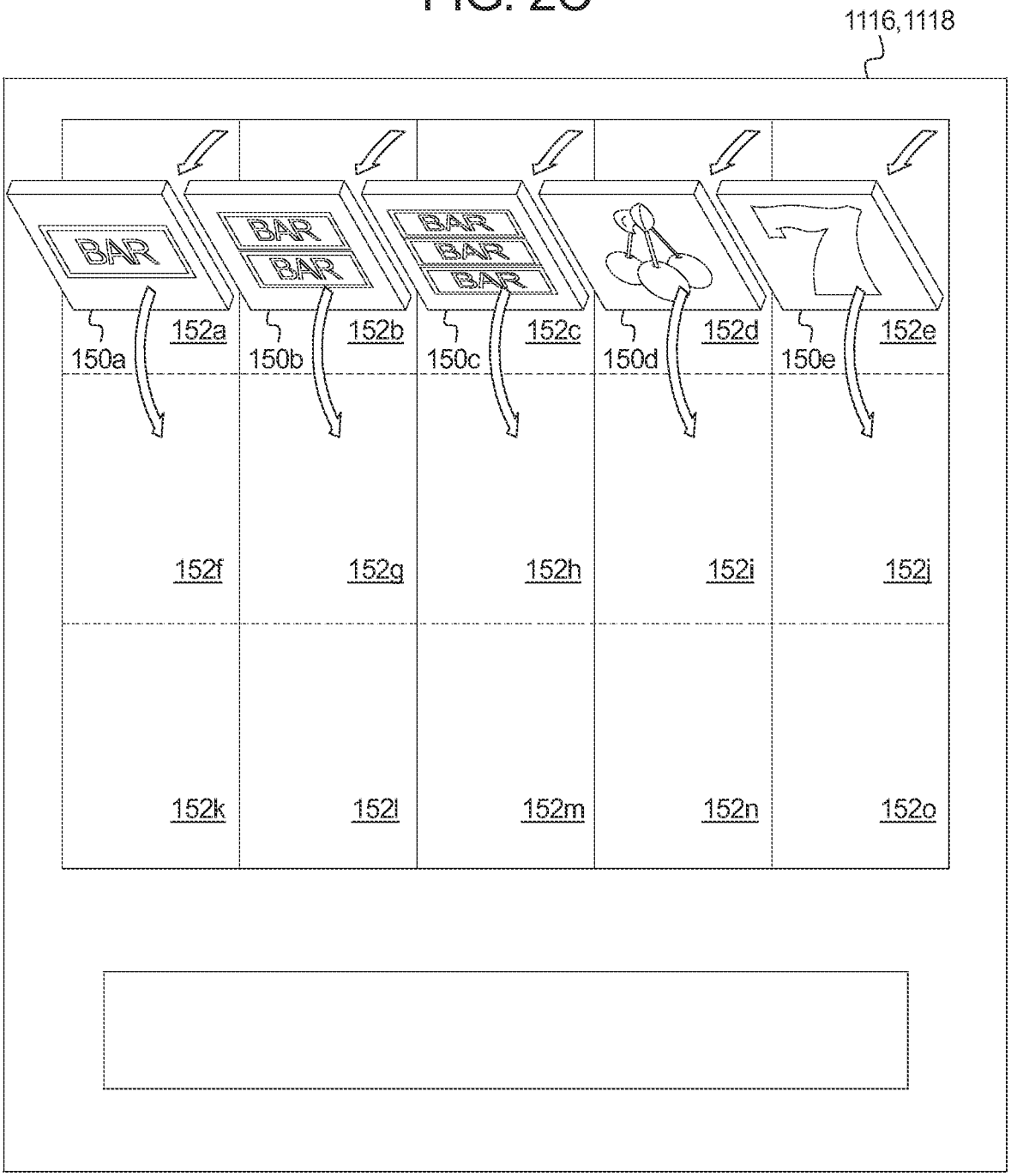
Figure 2D:
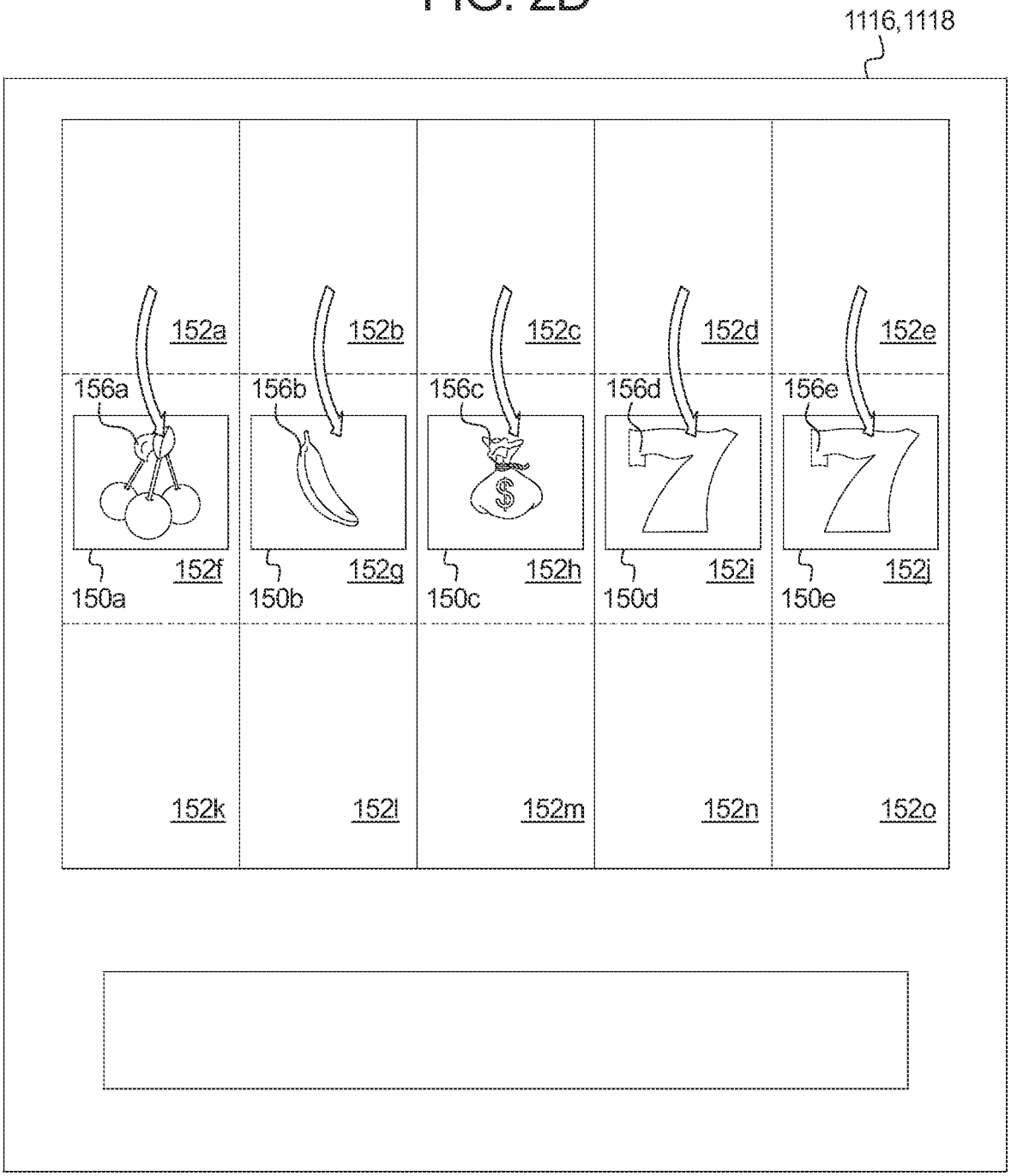
Figure 2E:
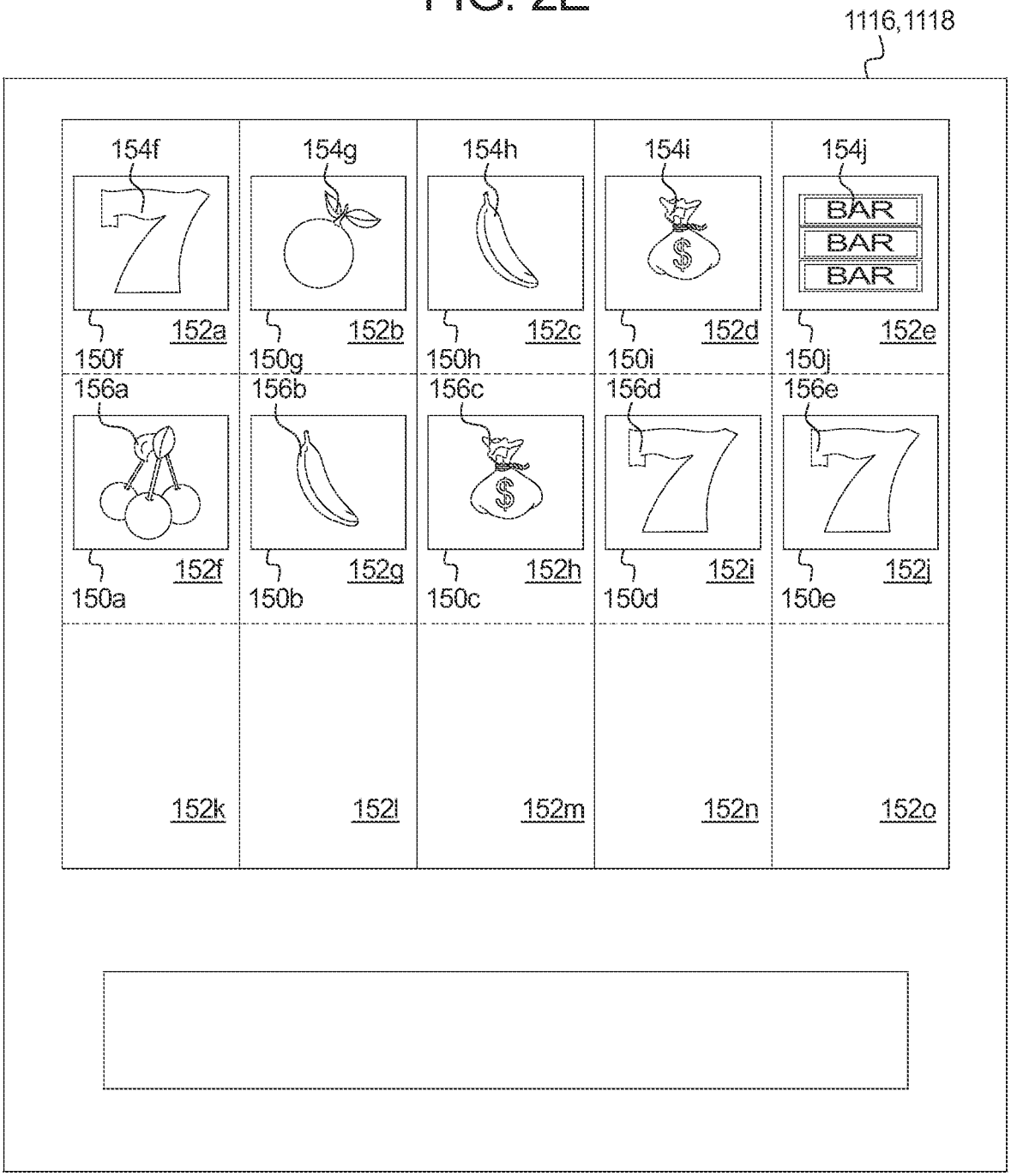
Figure 2F:
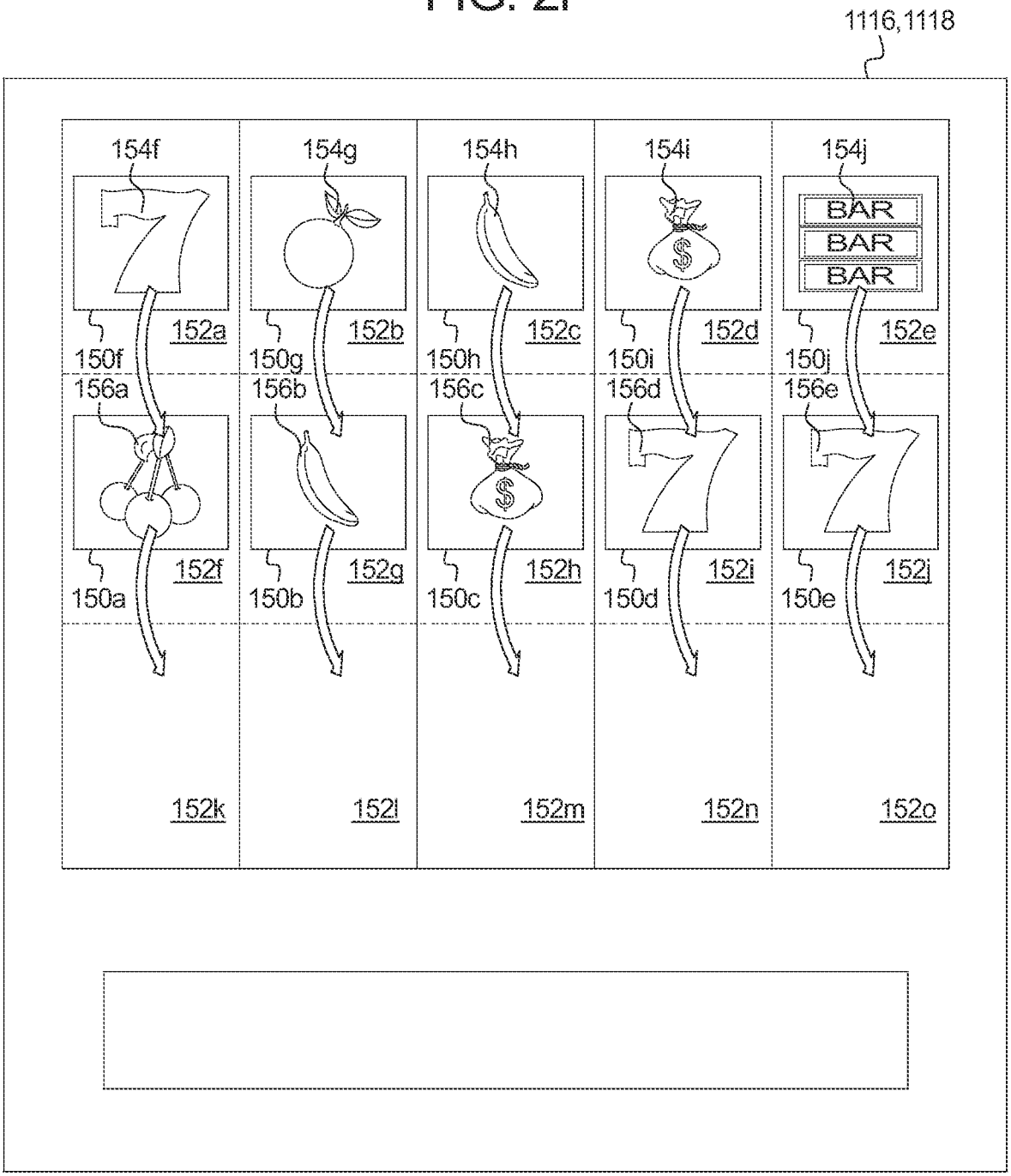
Figure 2G:
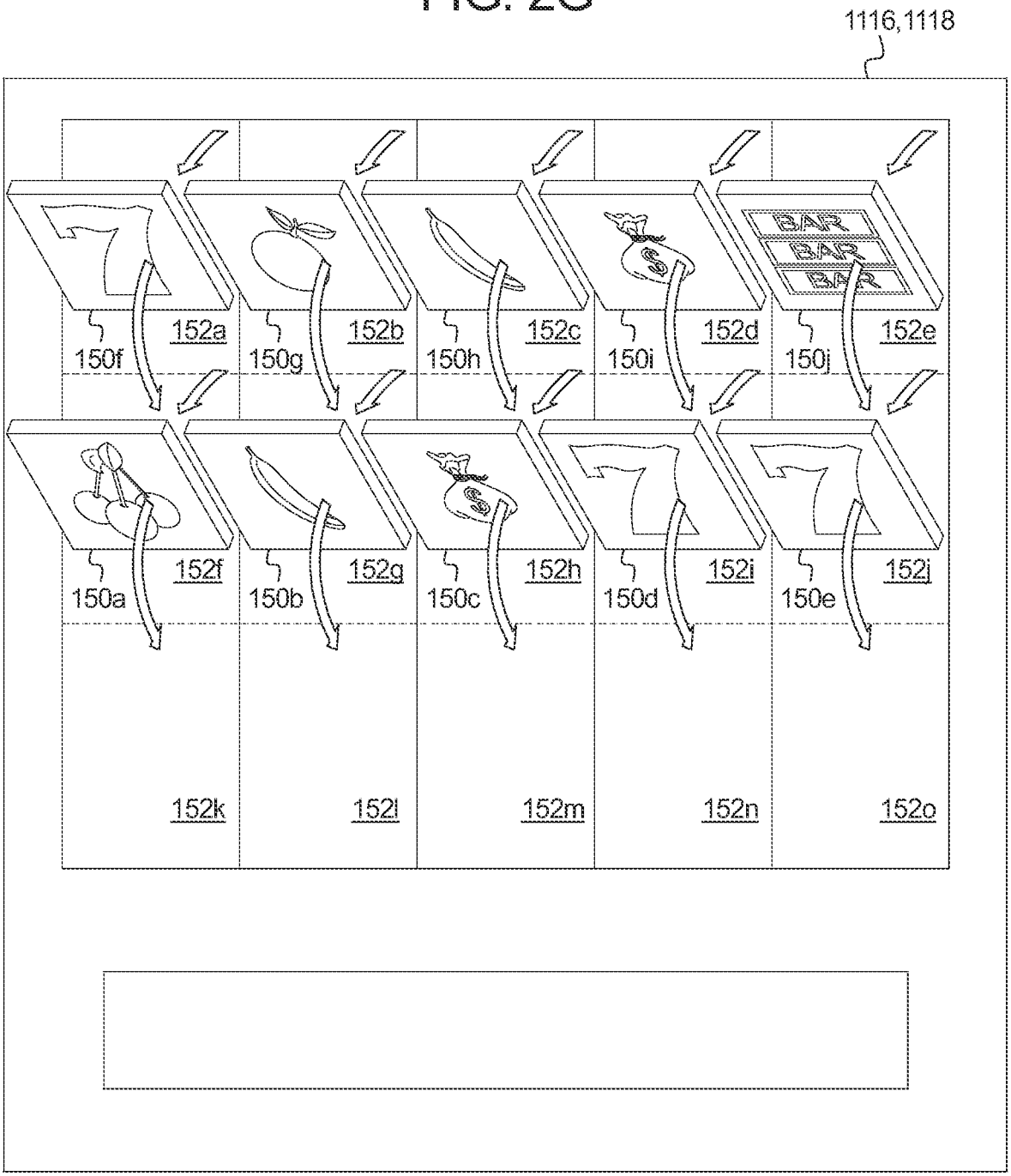
Figure 2H:
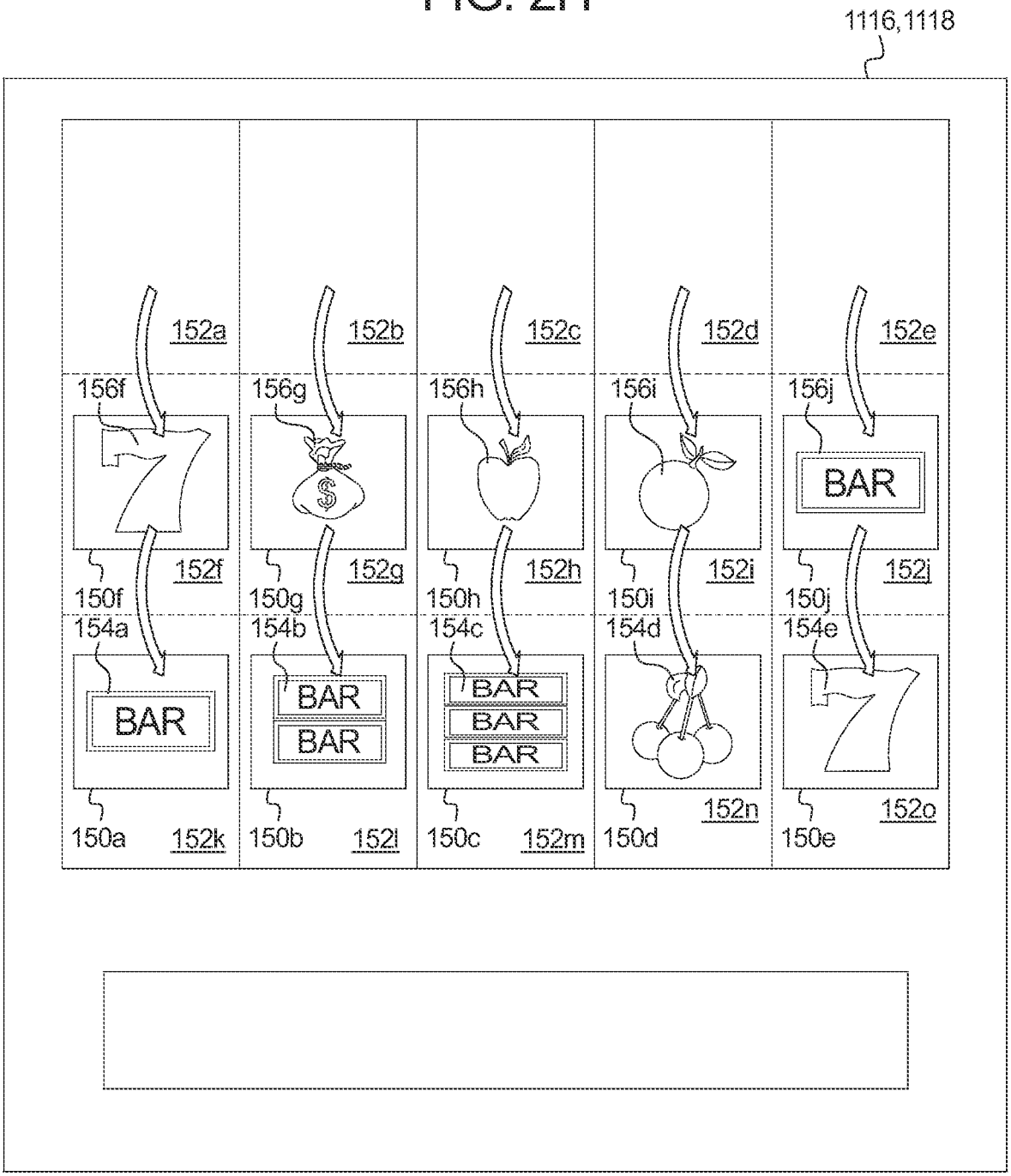

Specifically, as seen in FIG. 2A, the gaming system generates five multiple sided symbols 150*a*, 150*b*, 150*c*, 150*d* and 150*e* and displays these five multiple sided symbols at symbol display positions 152*a*, 152*b*, 152*c*, 152*d* and 152*e*, respectively, of a first or top row of the symbol display position matrix. For each of the multiple sided symbols, the gaming system displays one symbol of one side or face of that multiple sided symbol such that: (i) the gaming system displays the single bar symbol 154*a* on a first side or face of multiple sided symbol 150*a*; (ii) the gaming system displays the double bar symbol 154*b* on a first side or face of multiple sided symbol 150*b*; (iii) the gaming system displays the triple bar symbol 154*c* on a first side or face of multiple sided symbol 150*c*; (iv) the gaming system displays the cherry symbol 154*d* on a first side or face of multiple sided symbol 150*d*; and (v) the gaming system displays the seven symbol 154*e* on a first side or face of multiple sided symbol 150*e*.

Following the initial display of these multiple sided symbols at the symbol display positions of the top row of the symbol display position matrix, the gaming system moves, shifts or cascades these multiple sided symbols to the symbol display positions of the second or middle row of the symbol display position matrix. In association with this movement, the gaming system rotates such multiple sided symbols (such as flipping a multiple sided symbol along that symbol's bottom edge) to display the symbols on the second or opposite sides or faces of such rotated multiple sided symbols.

As specifically seen in FIGS. 2B to 2E, in conjunction with shifting symbols 150*a*, 150*b*, 150*c*, 150*d* and 150*e* into symbol display positions 152*f*, 152*g*, 152*h*, 152*i* and 152*j*, respectively, of a second or middle row of the symbol display position matrix, the gaming system: (i) rotates multiple sided symbol 150*a* to display the cherry symbol 156*a* on another face of multiple sided symbol 150*a*; (ii) rotates multiple sided symbol 150*b* to display the banana symbol 156*b* on another face of multiple sided symbol 150*b*; (iii) rotates multiple sided symbol 150*c* to display the money bag symbol 156*c* on another face of multiple sided symbol 150*c*; (iv) rotates multiple sided symbol 150*d* to display the seven symbol 156*d* on another face of multiple sided symbol 150*d*; and (v) rotates multiple sided symbol 150*e* to display the seven symbol 156*e* on another face of multiple sided symbol 150*e*.

As further seen in FIGS. 2B to 2E, in addition to shifting and flipping the multiple sided symbols previously displayed in the first row of symbol display positions, the gaming system generates the next five multiple sided symbols 150*f*, 150*g*, 150*h*, 150*i* and 150*j* and initially displays these five multiple sided symbols at symbol display positions 152*a*, 152*b*, 152*c*, 152*d* and 152*e*, respectively, of the first or top row of the symbol display position matrix. For each of the multiple sided symbols, the gaming system displays one symbol of one side or face of that multiple sided symbol such that: (i) the gaming system displays the seven symbol 154*f* on a first side or face of multiple sided symbol 150*f*; (ii) the gaming system displays the orange symbol 154*g* on a first side or face of multiple sided symbol 150*g*; (iii) the gaming system displays the banana symbol 154*h* on a first side or face of multiple sided symbol 150*h*; (iv) the gaming system displays the money bag symbol 154*i* on a first side or face of multiple sided symbol 150*i*; and (v) the gaming system displays the triple bar symbol 154*j* on a first side or face of multiple sided symbol 150*j*.

Following the display of certain of these multiple sided symbols at the symbol display positions of the middle row of the symbol display position matrix, the gaming system moves, shifts or cascades these multiple sided symbols to the symbol display positions of a third or bottom row of the symbol display position matrix. Additionally, following the display of certain of these multiple sided symbols at the symbol display positions of the top row of the symbol display position matrix, the gaming system moves, shifts or cascades these multiple sided symbols to the symbol display positions of the second or middle row of the symbol display position matrix. In association with these movements, the gaming system rotates such multiple sided symbols (such as flipping a multiple sided symbol along that symbol's bottom edge) to display the symbols on the second or opposite sides or faces of such rotated multiple sided symbols.

As specifically seen in FIGS. 2F to 2I, in conjunction with shifting symbols 150*a*, 150*b*, 150*c*, 150*d* and 150*e* into symbol display positions 152*k*, 152*l*, 152*m*, 152*n* and 152*o*, respectively, of a third or bottom row of the symbol display position matrix, the gaming system: (i) rotates multiple sided symbol 150*a* to display the single bar symbol 154*a* on the first face of multiple sided symbol 150*a*; (ii) rotates multiple sided symbol 150*b* to display the double bar symbol 154*b* on the first face of multiple sided symbol 150*b*; (iii) rotates multiple sided symbol 150*c* to display the triple bar symbol 154*c* on the first face of multiple sided symbol 150*c*; (iv) rotates multiple sided symbol 150*d* to display the cherry symbol 154*d* on the first face of multiple sided symbol 150*d*; and (v) rotates multiple sided symbol 150*e* to display the seven symbol 154*e* on the first face of multiple sided symbol 150*e*. As seen in this example, this second rotation of each of these multiple sided symbols causes the symbol displayed on the first face of such multiple sided symbols to again be displayed.

As also seen in FIGS. 2F to 2I, in conjunction with shifting symbols 150*f*, 150*g*, 150*h*, 150*i* and 150*j* into symbol display positions 152*f*, 152*g*, 152*h*, 152*i* and 152*j*, respectively, of the second or middle row of the symbol display position matrix, the gaming system: (i) rotates multiple sided symbol 150*f* to display the seven symbol 156*f* on another face of multiple sided symbol 150*f*; (ii) rotates multiple sided symbol 150*g* to display the money bag symbol 156*g* on another face of multiple sided symbol 150*g*; (iii) rotates multiple sided symbol 150*h* to display the apple symbol 156*h* on another face of multiple sided symbol 150*h*; (iv) rotates multiple sided symbol 150*i* to display the orange symbol 156*i* on another face of multiple sided symbol 150*i*; and (v) rotates multiple sided symbol 150*j* to display the single bar symbol 156*j* on another face of multiple sided symbol 150*j*.

As further seen in FIGS. 2F to 2I, in addition to shifting and flipping the multiple sided symbols previously displayed in the first and second rows of symbol display positions, the gaming system generates the next five multiple sided symbols 150*k*, 150*l*, 150*m*, 150*n* and 150*o* and displays these five multiple sided symbols at symbol display positions 152*a*, 152*b*, 152*c*, 152*d* and 152*e*, respectively, of the first or top row of the symbol display position matrix. For each of the multiple sided symbols, the gaming system displays one symbol of one side or face of that multiple sided symbol such that: (i) the gaming system displays the cherry symbol 154*k* on a first side or face of multiple sided symbol 150*k*; (ii) the gaming system displays the banana symbol 154*l* on a first side or face of multiple sided symbol 150*l*; (iii) the gaming system displays the seven symbol 154*m* on a first side or face of multiple sided symbol 150*m*; (iv) the gaming system displays the cherry symbol 154*n* on a first side or face of multiple sided symbol 150*n*; and (v) the gaming system displays the bell symbol 154*o* on a first side or face of multiple sided symbol 150*o*.

Following the generation and display of the plurality of symbols in the plurality of symbol display positions, the gaming system determines whether the generated symbols form any winning symbol combinations as indicated in diamond 106 of FIG. 1.

If the generated symbols did not form any winning symbol combinations, the gaming system terminates the play of the cascading symbols game and returns to block 102 for another placement of another wager on any play of the cascading symbols game.

On the other hand, if the generated symbols form one or more winning symbol combinations as indicated in block 108, the gaming system causes an award to be displayed and provided for each formed winning symbol combination.

Figure 2I:
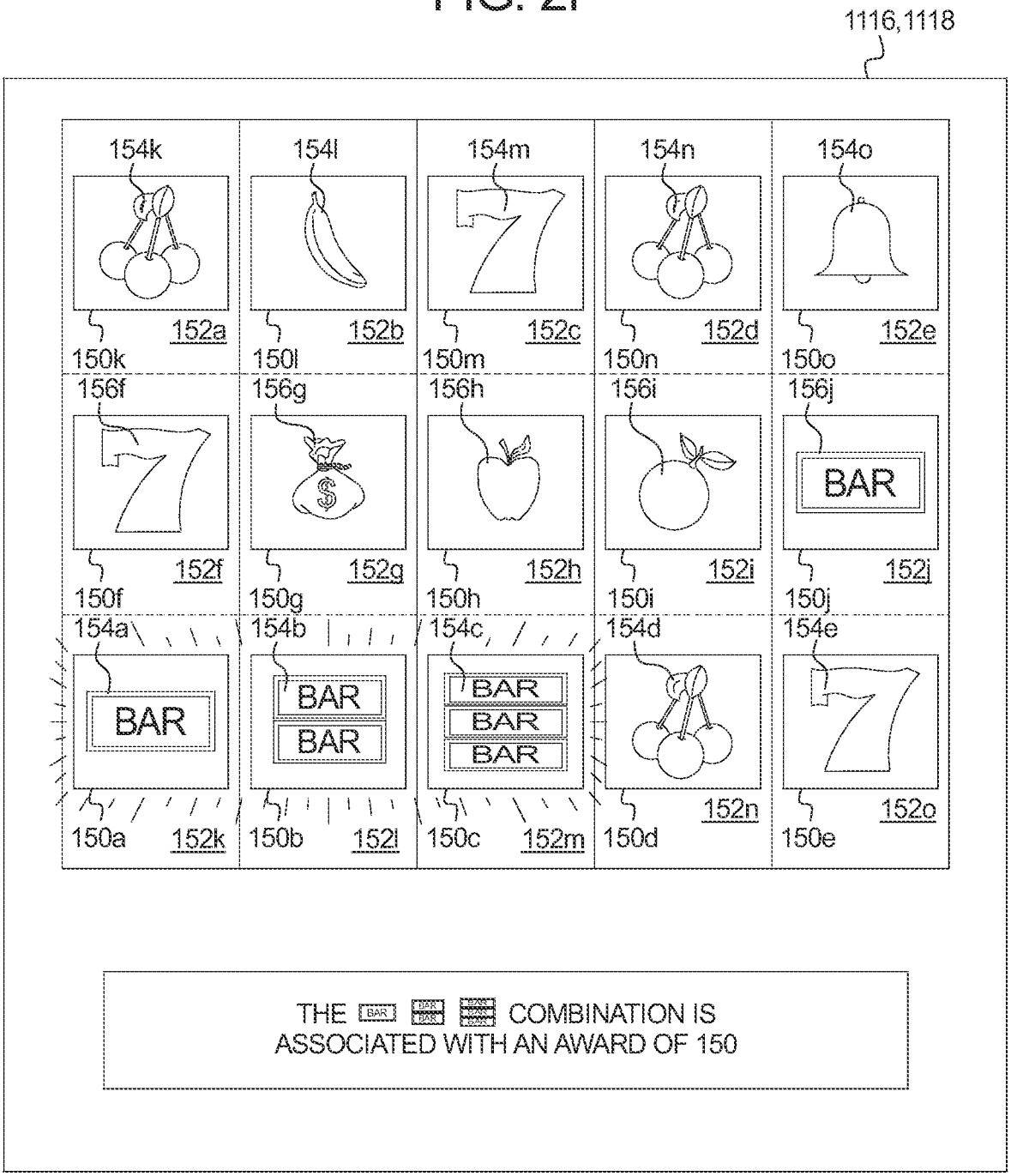

As seen in FIG. 2I, upon determining that the symbol combination of single bar symbol 154*a*-double bar symbol 154*b*-triple bar symbol 154*c* is a winning symbol combination, the gaming system provides the player an award of one-hundred-fifty credits associated with this winning symbol combination. In this example, the gaming system provides appropriate messages such as "THE SINGLE BAR-DOUBLE BAR-TRIPLE BAR COMBINATION IS ASSOCIATED WITH AN AWARD OF 150" to the player visually, or through suitable audio or audiovisual displays.

It should be appreciated that in certain instances, the rotation of one or more multiple sided symbols will cause the formation of a winning symbol combination (wherein without such rotation(s), no winning symbol combination would be formed). For example, as seen in FIGS. 2A to 2I, the rotation of multiple sided symbol 150*a* (which caused the single bar symbol 154*a* on one side of multiple sided symbol 150*a* to be displayed to the player instead of the cherry symbol 156*a* on the other side of multiple sided symbol 150*a*), the rotation of multiple sided symbol 150*b* (which caused the double bar symbol 154*b* on one side of multiple sided symbol 150*b* to be displayed to the player instead of the banana symbol 156*b* on the other side of multiple sided symbol 150*b*), and the rotation of multiple sided symbol 150*c* (which caused the triple bar symbol 154*c* on one side of multiple sided symbol 150*c* to be displayed to the player instead of the money bag symbol 156*c* on the other side of multiple sided symbol 150*c*) resulted in a formation of a winning symbol combination for the player. Put differently, had at least one of multiple sided symbol 150*a*, multiple sided symbol 150*b* or multiple sided symbol 150*c* shifted into symbol display positions 152*k*, 152*l* and 152*m*, respectively, without rotating, no winning symbol combination would have been formed from these multiple sided symbols.

Following providing the player any awards associated with any winning symbol combinations, the gaming system removes one or more of the symbols included in one or more of the formed winning symbol combinations to create one or more empty symbol display positions as indicated in block 110 of FIG. 1.

Figure 2J:
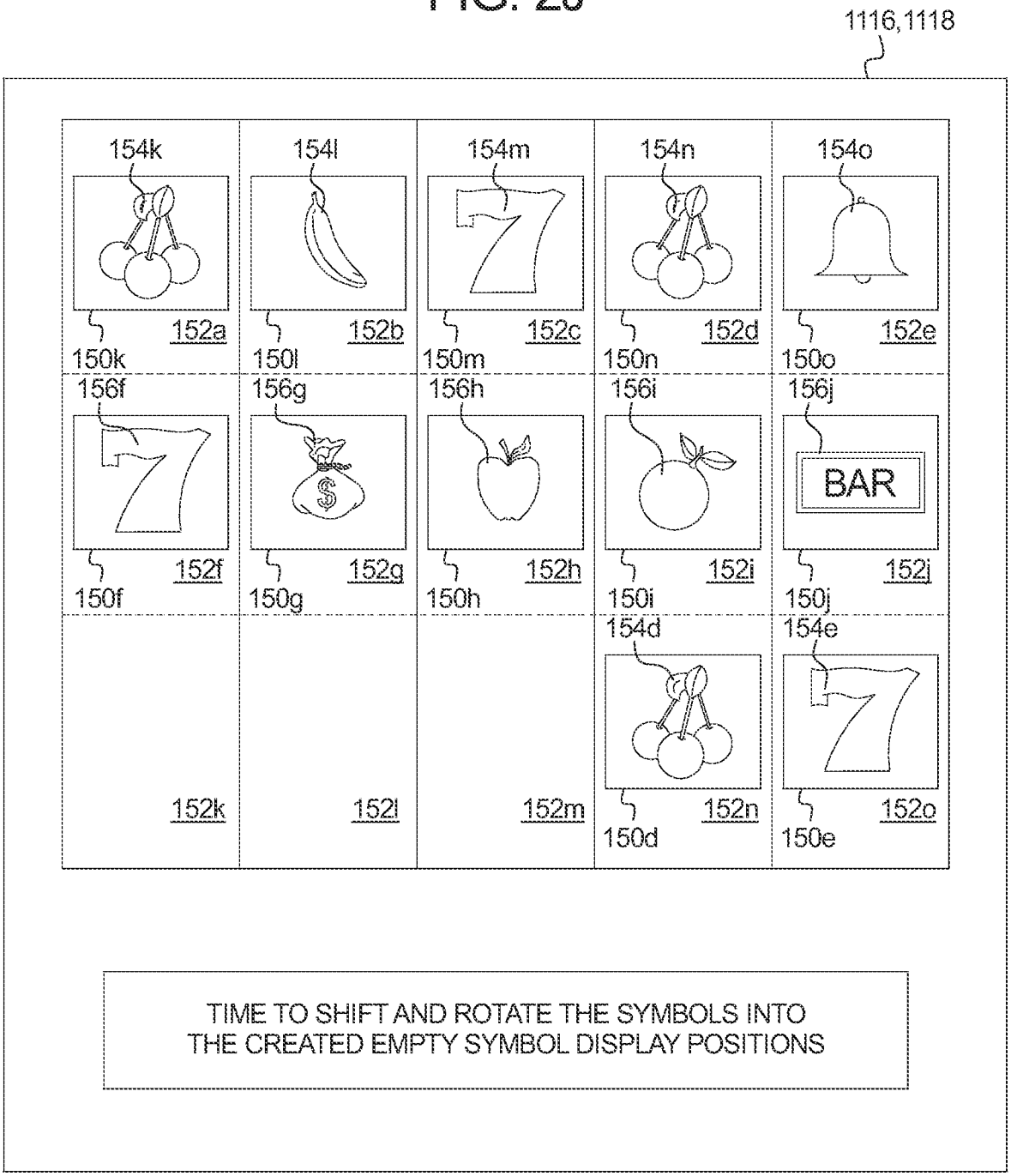

For example, as seen in FIG. 2J, the gaming system removes the single bar symbol 154*a*, the double bar symbol 154*b* and the triple bar symbol 154*c* which form the winning symbol combination. This removal creates empty symbol display positions 152*k*, 152*l* and 152*m*. In this example, the gaming system provides appropriate messages such as "TIME TO SHIFT AND ROTATE THE SYMBOLS INTO THE CREATED EMPTY SYMBOL DISPLAY POSITIONS" to the player visually, or through suitable audio or audiovisual displays.

Following the removal of one or more symbols from one or more symbol display positions, as indicated in block 112 of FIG. 1, the gaming system displays another symbol in zero, one or more of the created empty symbol display positions by shifting one or more of the remaining symbols into one or more of any empty symbol display positions. As further indicated in block 112, in association with shifting zero, one or more of any remaining multiple sided symbols, the gaming system flips or rotates the displayed face of such shifted multiple sided symbols to display another symbol of another face of such symbols.

Figure 2K:
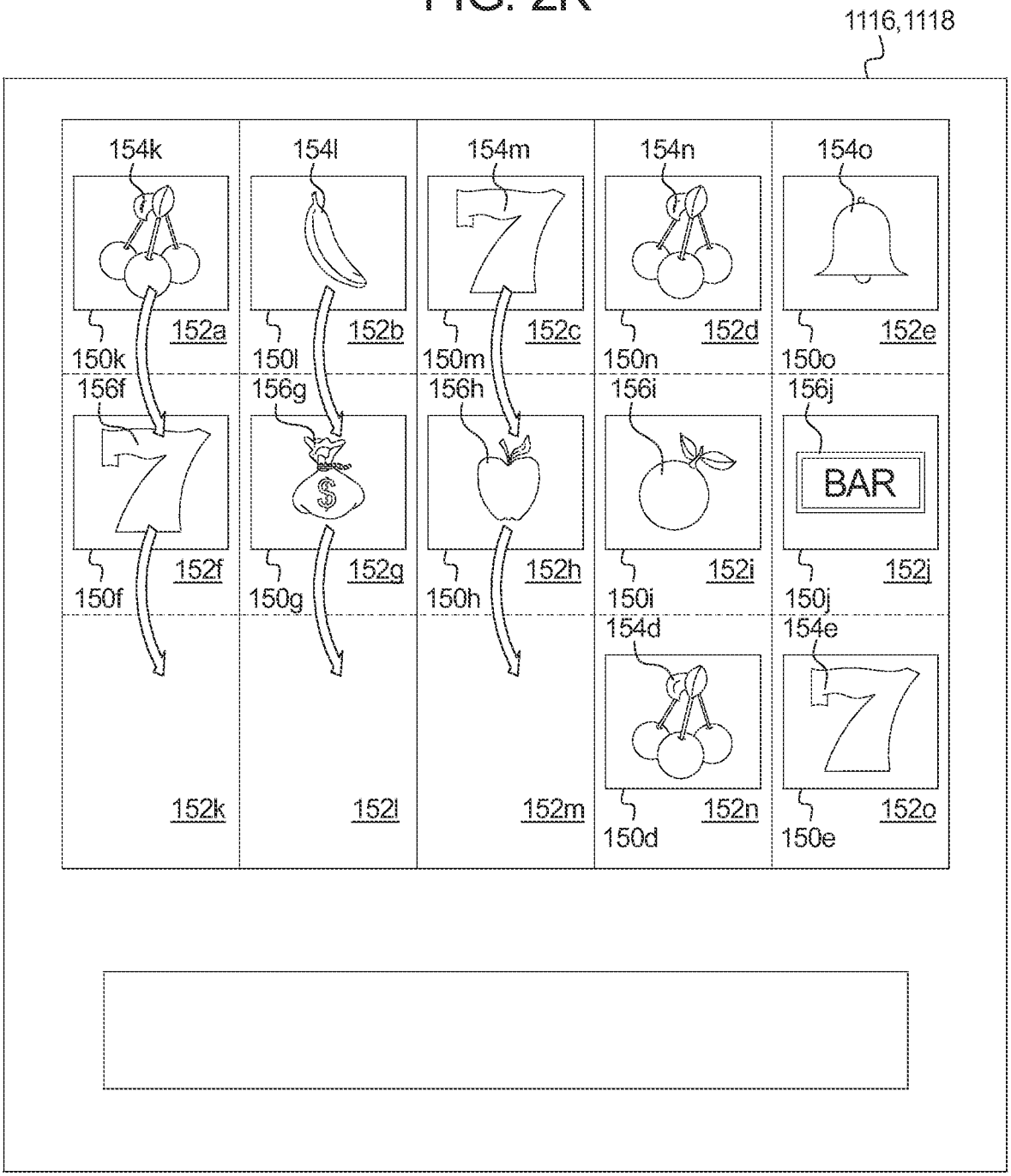
Figure 2L:
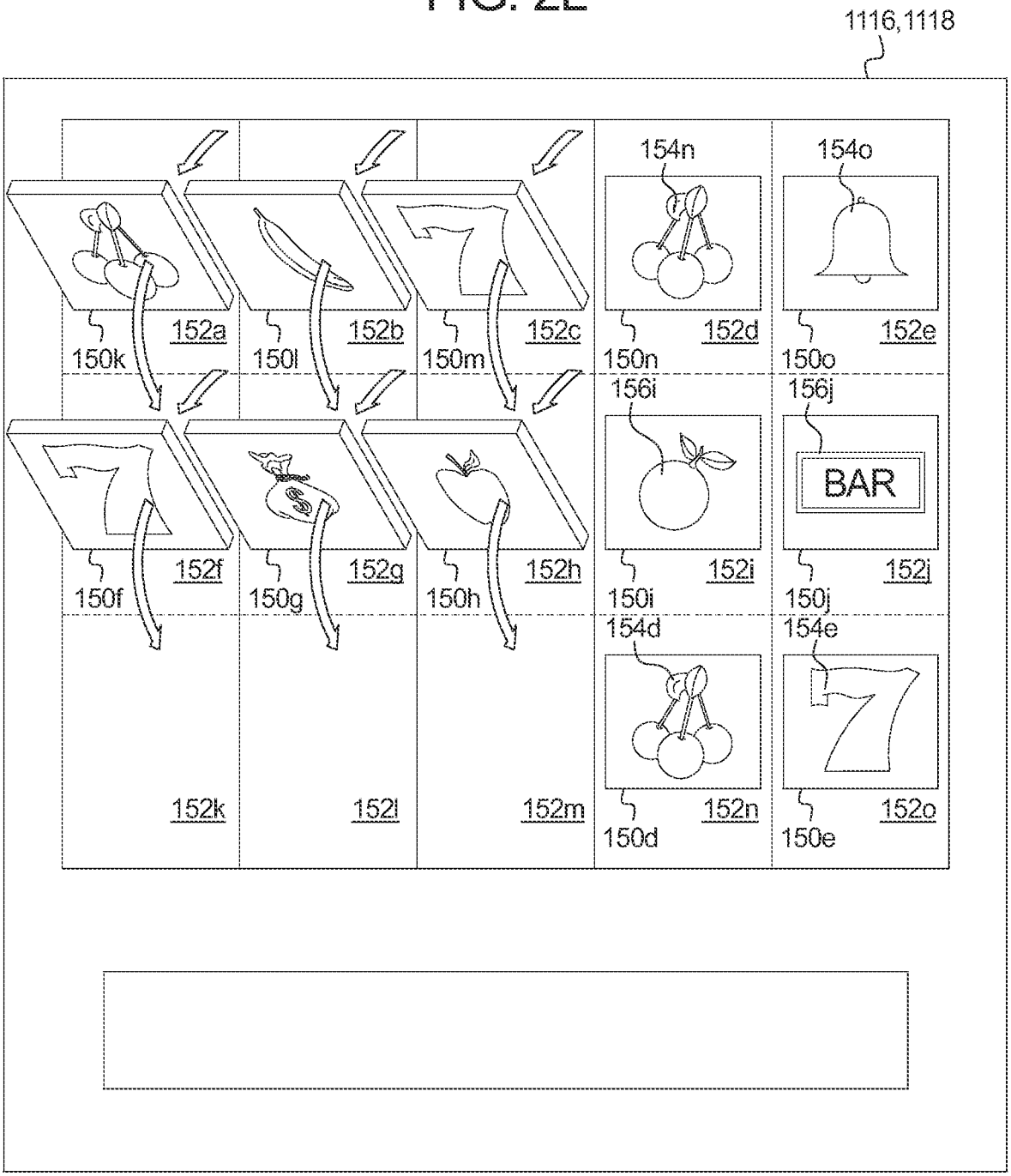
Figure 2M:
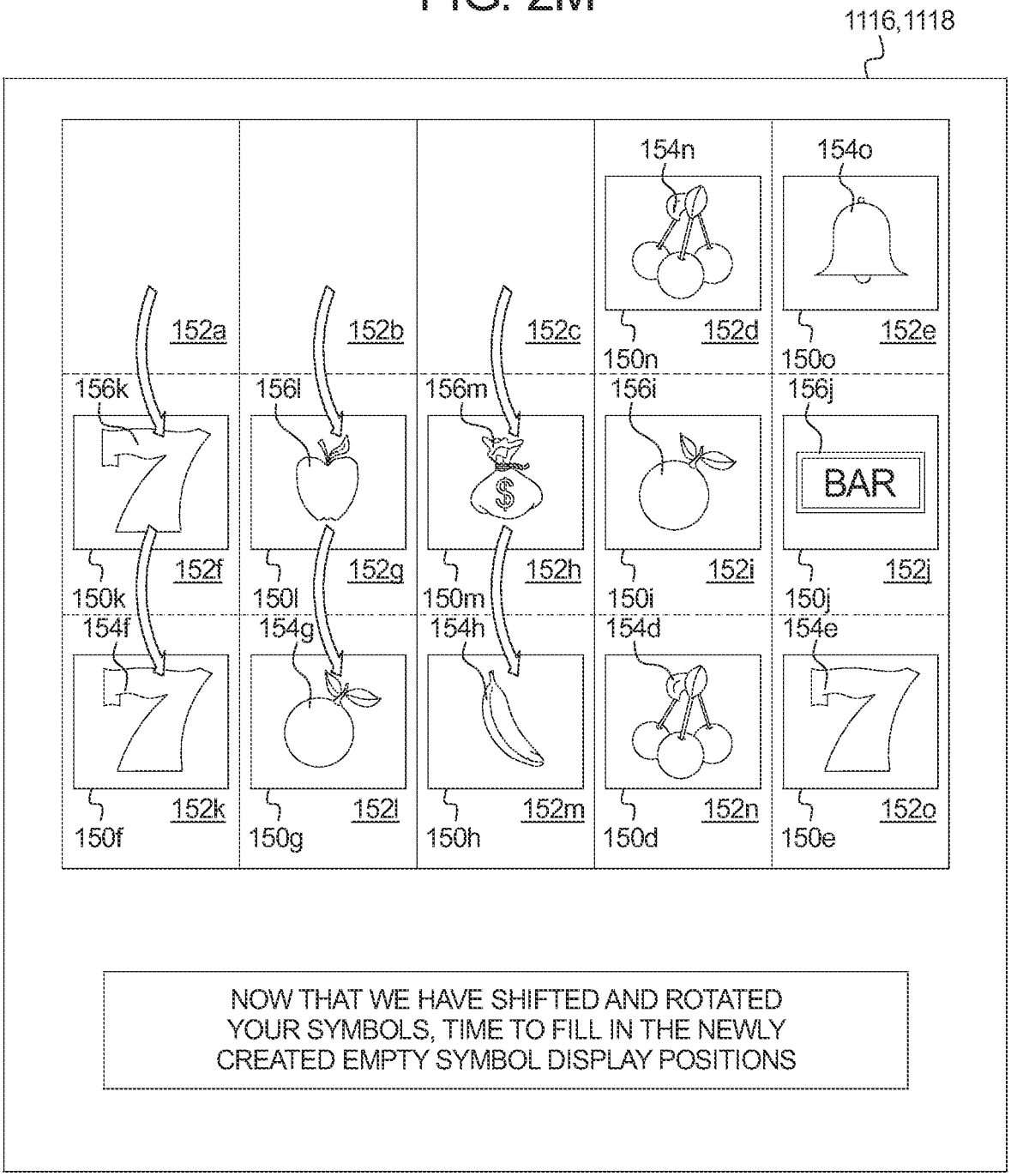

For example, as seen in FIGS. 2K to 2M, following the creation of empty symbol display positions 152*k*, 152*l* and 152*m*, the gaming system shifts symbols 150*f*, 150*g* and 150*h* into symbol display positions 152*k*, 152*l* and 152*m*, respectively, of the third or bottom row of the symbol display position matrix and also shifts symbols 150*k*, 150*l* and 150*m* into symbol display positions 152*f*, 152*h* and 152*g*, respectively, of the second or middle row of the symbol display position matrix. Such shifting creates empty symbol display positions 152*a*, 152*b* and 152*c*.

As further seen in FIGS. 2K to 2M, in conjunction with this shifting, the gaming system: (i) rotates multiple sided symbol 150*f* to display the seven symbol 154*f* on the first face of multiple sided symbol 150*f*; (ii) rotates multiple sided symbol 150*g* to display the orange symbol 154*g* on the first face of multiple sided symbol 150*g*; (iii) rotates multiple sided symbol 150*h* to display the banana symbol 154*h* on the first face of multiple sided symbol 150*h*; (iv) rotates multiple sided symbol 150*k* to display the seven symbol 156*k* on another face of multiple sided symbol 150*k*; (v) rotates multiple sided symbol 150*l* to display the apple symbol 156*l* on another face of multiple sided symbol 150*l*; and (vi) rotates multiple sided symbol 150*m* to display the money bag symbol 156*m* on another face of multiple sided symbol 150*m*. In this example, the gaming system provides appropriate messages such as "NOW THAT WE HAVE SHIFTED AND ROTATED YOUR SYMBOLS, TIME TO FILL IN THE NEWLY CREATED EMPTY SYMBOL DISPLAY POSITIONS" to the player visually, or through suitable audio or audiovisual displays.

In one embodiment, the gaming system shifts zero, one or more symbols into zero, one or more of the created empty symbol display positions according to applicable game rules. For example, under one set of applicable game rules wherein symbols are shifted downward to fill empty symbol display positions, if a winning symbol combination results in a displayed empty symbol display position along a bottom row of symbol display positions, the gaming system will shift at least one symbol in a symbol display position above the empty symbol display position downward to fill the empty symbol display position. It should be appreciated that in this example, under these applicable set of game rules, if a winning symbol combination results in a displayed empty symbol display position along a top row of symbol display positions, the gaming system will not shift any symbols to fill the empty symbol display position.

In one such embodiment, the gaming system shifts any remaining symbols as many symbol display positions as possible in a designated direction, while maintaining the position of each shifted symbol relative to one or more other symbols or coordinates. For instance, the gaming system in one embodiment moves each symbol positioned in a symbol display position adjacently above an empty symbol display position of a column of a symbol display position matrix (displayed as a reel) downward as far as possible to occupy one or more empty symbol display positions while maintaining the relative order of the symbols of that column of the symbol display position matrix from top to bottom. In this embodiment, shifting the non-removed symbols does not result in fewer empty symbol display positions. Rather, shifting the non-removed symbols results in a plurality of different empty symbol display positions wherein each empty symbol display position has a given relationship to any remaining symbols, the relationship based on the direction of shifting. In one embodiment, for each of a plurality of columns of a symbol display position matrix, displayed as a plurality of reels, each of empty symbol display positions on the displayed reel resulting from shifting one or more non-removed symbols is above each of any remaining displayed symbols on the displayed reel. It should be appreciated that in various embodiments, shifting symbols downward (or upward, or sideways or diagonally or any suitable direction) to fill one or more empty symbol display positions causes a cascading, tumbling, or falling appearance of the symbols in the gaming system, which increases player excitement and enjoyment.

After shifting zero, one or more symbols to create zero, one or more different empty symbol display positions, the gaming system displays a symbol in each of any of the created empty symbol display positions by generating another symbol in that created empty symbol display position as indicated in block 114 of FIG. 1.

Following the display of a symbol in each of the created empty symbol display positions, the gaming system then returns to diamond 106 and proceeds with determining whether the generated symbols (i.e., the non-removed symbols from a previous generation and display of at least one symbol and the newly displayed symbols) form any winning symbol combinations.

Figure 2N:
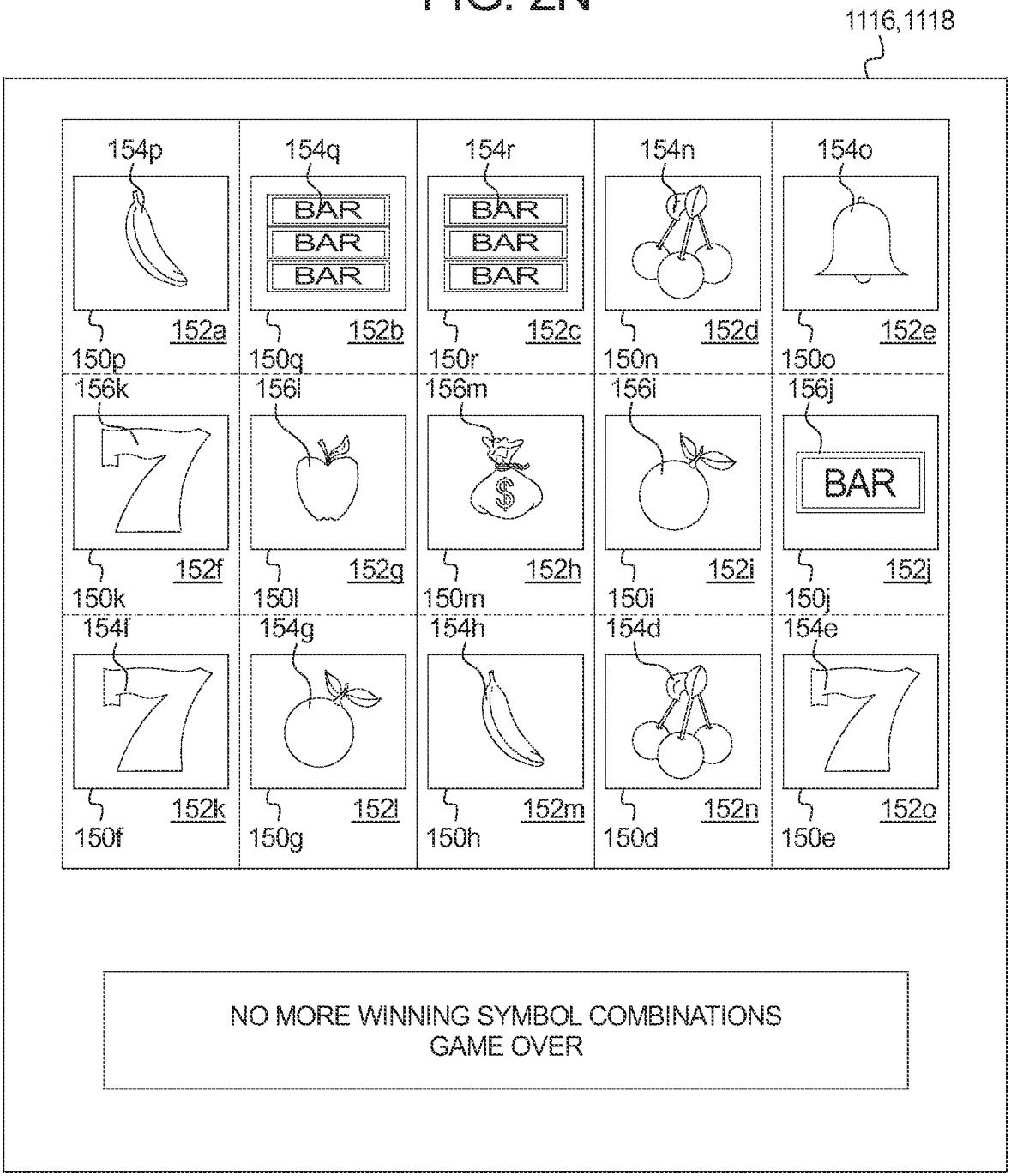

For example, as seen in FIG. 2N, following the shifting and flipping of a plurality of the remaining symbols, the gaming system generates multiple sided symbols 150*p*, 150*q*, and 150*r*, and displays these multiple sided symbols at symbol display positions 152*a*, 152*b*, and 152*c*, respectively, of the first or top row of the symbol display position matrix. For each of the multiple sided symbols, the gaming system displays one symbol of one side or face of that multiple sided symbol such that: (i) the gaming system displays the banana symbol 154*p* on a first side or face of multiple sided symbol 150*p*; (ii) the gaming system displays the triple bar symbol 154*q* on a first side or face of multiple sided symbol 150*q*; and (iii) the gaming system displays the triple bar symbol 154*r* on a first side or face of multiple sided symbol 150*r*.

As further seen in FIG. 2N, since none of the currently generated symbols form any winning symbol combinations associated with any awards, the gaming system terminates the play of the cascading symbols game and awaits another placement of another wager. In this example, the gaming system provides appropriate messages such as "NO MORE WINNING SYMBOL COMBINATIONS" and "GAME OVER" to the player visually, or through suitable audio or audiovisual displays.

It should be appreciated that in certain instances, the rotation of one or more multiple sided symbols will prevent the formation of a winning symbol combination (wherein without such rotation(s), a winning symbol combination would be formed). For example, as seen in FIGS. 2K to 2M, the rotation of multiple sided symbol 150*l* (which caused the apple symbol 156*l* on one side of multiple sided symbol 150*l* to be displayed to the player instead of the banana symbol 154*l* on the other side of multiple sided symbol 150*l*) resulted in a formation of a non-winning symbol combination for the player. Put differently, had multiple sided symbol 150*l* shifted into symbol display position 152*g* without rotating to display the apple symbol 156*l*, a banana symbol-banana symbol-banana symbol winning combination would have been formed for the player.

In one embodiment, as seen in FIGS. 2A to 2N, each of the sides or faces of each generated multiple sided symbol includes a distinct symbol. In another embodiment, each of the sides or faces of a plurality of the generated multiple sided symbol includes a distinct symbol. In another embodiment, each of the sides or faces of at least one of the generated multiple sided symbols includes a distinct symbol. In another embodiment, a plurality, but not all, of the sides or faces of each of the generated multiple sided symbols each include a distinct symbol. In another embodiment, a plurality, but not all, of the sides or faces of a plurality of the generated multiple sided symbols each include a distinct symbol. In another embodiment, a plurality, but not all, of the sides or faces of at least one of the generated multiple sided symbols each include a distinct symbol.

In one embodiment, as described above and illustrated in FIGS. 2A to 2N, each of the symbols generated are multiple sided symbols. In another embodiment, at least one of the symbols generated is a multiple sided symbol and at least one of the symbols generated is a single sided symbol (which do not flip or rotate as such symbols shift or move from symbol display position to symbol display position). In another embodiment, a plurality of the symbols generated are multiple sided symbols and a plurality of the symbols generated are single sided symbols.

In one embodiment, as described above and illustrated in FIGS. 2A to 2N, each of the multiple sided symbols generated are two-dimensional symbols with a distinct symbol on each of the two sides of this two-sided symbol. In another embodiment, at least one of the multiple sided symbols generated is a two-dimensional symbol and at least one of the multiple sided symbols generated is a three-dimension symbol with a distinct symbol on zero, one or more of each of at least three sides of this three-dimensional symbol. In another embodiment, each of the multiple sided symbols generated are three dimensional symbols with a distinct symbol on zero, one or more of each of the at least three sides of this three-dimensional symbol.

In one embodiment, the symbol on each side or face of a multiple sided symbol is different. For example, as seen in FIGS. 2A to 2E, multiple sided symbol 150*a* includes a single bar symbol 154*a* on one side of this multiple sided symbol and a different symbol (e.g., a cherry symbol 156*a*) on another side of this multiple sided symbol. In another embodiment, the symbols on each of a plurality of sides or faces of a multiple sided symbol are different. In another embodiment, the symbol on each side or face of a multiple sided symbol are the same. For example, as seen in FIGS. 2E to 2H, multiple sided symbol 150*f* includes a seven symbol 154*f* on one side of this multiple sided symbol and the same symbol (e.g., a seven symbol 156*f*) on another side of this multiple sided symbol. In one embodiment, the symbol on each of a plurality of sides or faces of a multiple sided symbol are the same.

In one embodiment, as described above, when each generated multiple sided symbol shifts or moves into another symbol display position, the gaming system flips or rotates that multiple sided symbol. In another embodiment, when each of one or more generated multiple sided symbol shifts or moves into another symbol display position, the gaming system flips or rotates that multiple sided symbol and when each of one or more generated multiple sided symbols shifts or moves into another symbol display position, the gaming system does not flip or rotate that multiple sided symbol. In this embodiment, each non-flipping or non-rotating multiple sided symbol slides or shifts in any suitable direction, such as downward, upward, sideways or diagonally, from one symbol display position to another symbol display position. It should be appreciated that in one embodiment, a multiple sided symbol flips into certain symbol display positions and slides into other symbol display positions.

In one embodiment, the gaming system determines if a multiple sided symbol will rotate or not rotate from one symbol display position to another symbol display position based on if rotating the multiple sided symbol results in a symbol combination associated with a higher award value (than any award associated with any symbol combination resulting from not rotating the multiple sided symbol). In another embodiment, the gaming system determines if a multiple sided symbol will rotate or not rotate from one symbol display position to another symbol display position based on the current configuration of the multiple sided symbol. In another embodiment, the gaming system determines if a multiple sided symbol will rotate or not rotate from one symbol display position to another symbol display position based on one or more generated sub-symbols. In another embodiment, the gaming system determines if a multiple sided symbol will rotate or not rotate from one symbol display position to another symbol display position based a placement of a wager, such as a side wager or a maximum wager. In another embodiment, the gaming system determines if a multiple sided symbol will rotate or not rotate from one symbol display position to another symbol display position based on a designation (i.e., a rotation designation or a non-rotation designation) associated with the current symbol display position of that multiple sided symbol. In another embodiment, the gaming system determines if a multiple sided symbol will rotate or not rotate from one symbol display position to another symbol display position based on a designation (i.e., a rotation designation or a non-rotation designation) associated with the moved to symbol display position of that multiple sided symbol.

In another embodiment, the gaming system determines if a multiple sided symbol will rotate or not rotate from one symbol display position to another symbol display position based on one or more player inputs. In one such embodiment, the gaming system enables a player to designate, possibly within a predefined period of time, if an individual multiple sided symbol will rotate or not. In another such embodiment, the gaming system enables a player to designate, possibly within a predefined period of time, if a group or collection of a plurality of multiple sided symbols will each rotate or not. It should be appreciated that these embodiments include a degree of player strategy and skill as certain players determine, based on any previous display of any symbols on any currently hidden sides of one or more multiple sided symbols, whether to flip or rotate such symbols.

In another embodiment which includes one or more player inputs, the gaming system enables a player to designate one or more of the multiple sided symbols wherein the gaming system removes any non-player designated multiple sided symbols in association with the next shifting of one or more multiple sided symbols. In this embodiment, the gaming system enables a player to hold one or more symbols wherein one or more non-held symbols are subsequently removed from the symbol display position grid. In one such embodiment, the gaming system implements this feature based on the placement of a wager, such as a side wager or a maximum wager. In another embodiment which includes one or more player inputs, the gaming system enables a player to designate one or more of the multiple sided symbols wherein the gaming system removes any player designated multiple sided symbols in association with the next shifting of one or more multiple sided symbols. In this embodiment, the gaming system enables a player to discard one or more symbols wherein one or more non-discarded symbols are held at one or more symbol display positions within the symbol display position grid. In one such embodiment, the gaming system implements this feature based on the placement of a wager, such as a side wager or a maximum wager.

In one embodiment, as described above and illustrated in FIGS. 2A to 2N, the gaming system rotates one or more multiple sided symbols vertically (i.e., along a horizontal axis) as such multiple sided symbols move from symbol display position to symbol display position. In another embodiment, the gaming system rotates one or more multiple sided symbols horizontally (i.e., along a vertical axis) as such multiple sided symbols move from symbol display position to symbol display position. In this embodiment, if the horizontal rotation of a multiple sided symbols results in the displayed symbol being upside down, the gaming system turns or otherwise modifies that symbol to be displayed right side up. In another embodiment, the gaming system: (i) rotates one or more multiple sided symbols vertically as such multiple sided symbols move from symbol display position to symbol display position, and (ii) rotates one or more multiple sided symbols horizontally as such multiple sided symbols move from symbol display position to symbol display position. In another embodiment wherein one or more of the multiple sided symbols are multiple dimension, multiple sided symbols, for one or more rotations, the gaming system rotates such symbols vertically and horizontally.

In another embodiment, the gaming system utilizes a plurality of different sets of symbol display position grids. In one such embodiment, at least a first area, column or row of a first set of symbol display position grids is associated with or linked to at least a first area, column or row of a second set of symbol display position grids and at least a second area, column or row of the first set of symbol display position grids is not associated with or linked to any area, column or row in any second set of symbol display position grids. In a play of the game, as described above, symbols are independently generated for each set of symbol display position grids and the symbols displayed for each set of symbol display position grids are independently evaluated to provide any awards for any winning symbols or winning symbol combinations. After the evaluation, the gaming system removes zero, one, or more symbols to leave zero, one, or more empty symbol display positions. In one embodiment, if any empty symbol display positions are formed on the first area, column or row of the first set of symbol display position grids, the gaming system flips and shifts or transfers one or more symbols from the first area, column or row of the first set of symbol display position grids to the linked first area, column or row of the second set of symbol display position grids to occupy the one or more empty symbol display positions. In this embodiment, if there are any empty symbol display positions on the second area, column or row of the first set of symbol display position grids, the gaming system does not flip and shift or transfer any symbols from the second area, column or row of the first set of symbol display position grids to the second area, column or row of the second set of symbol display position grids. The gaming system then independently evaluates the symbols displayed for each set of symbol display position grids to provide any awards for any winning symbols or winning symbol combinations.

In one embodiment utilizing a plurality of different sets of symbol display position grids, one or more multiple sided symbols slide from symbol display position to symbol display position within a single symbol display position grid wherein such multiple sided symbols flip or rotate when moving to another symbol display position grid. In another embodiment utilizing a plurality of different sets of symbol display position grids, one or more multiple sided symbols slip or rotate from symbol display position to symbol display position within a single symbol display position grid wherein such multiple sided symbols slide when moving to another symbol display position grid.

In one embodiment, as described above, the gaming system causes zero, one or more symbols to tumble and/or shift downward (or upward, or sideways or diagonally or any suitable direction) to fill one or more empty symbol display positions. In another embodiment, the gaming system utilizes different directions of movement for different symbol movements in association with a play of the cascading multiple sided symbols game. In one such embodiment, the gaming system causes the initial generation of the multiple sided symbols to shift, with or without flipping, to downwards wherein if any empty symbol display positions are subsequently created, the gaming system causes zero, one or more remaining multiple sided symbols to shift, with or without flipping, sideways.

In one embodiment, the gaming system causes one or more multiple sided symbols to rotate without moving or shifting into another symbol display position (i.e., such multiple sided symbols rotate in place). In another embodiment, if a winning symbol combination occurs, rather than removing one or more multiple sided symbols from the winning symbol combination, the gaming system causes one or more multiple sided symbols included in the winning symbol combination to rotate in place to display another symbol on another side of such a multiple sided symbol. In one embodiment, the gaming system determines if a multiple sided symbol will rotate without moving symbol display positions based on one or more random determinations. In another embodiment, the gaming system determines if a multiple sided symbol will rotate without moving symbol display positions based on if such rotation will cause a winning symbol combination to be generated. In another embodiment, in association with one or more plays of a free spins game, the gaming system causes a multiple sided symbol to rotate without moving symbol display positions.

In one embodiment, the gaming system flips or rotates one or more multiple sided symbols in association with: (i) an initial generation of one or more multiple sided symbols, (ii) a shifting of one or more previously generated multiple sided symbols (following the removal of one or more generated symbols) and/or (iii) a subsequent generation of one or more multiple sided symbols (following any shifting of any previously generated symbols). In another embodiment, the gaming system flips or rotates one or more multiple sided symbols in association with: (i) a shifting of one or more previously generated multiple sided symbols (following the removal of one or more generated symbols) and/or (iii) a subsequent generation of one or more multiple sided symbols (following any shifting of any previously generated symbols). In this embodiment, the flipping or rotation of one or more multiple sided symbols occurs after the removal of one or more generated symbols to create one or more empty symbol display positions.

In another embodiment, the gaming system disclosed herein utilizes the fourth dimension of time to determine any awards to be provided to a player. In one such embodiment, the gaming system associates certain multiple sided symbols with a duration or quantity until such multiple sided symbols flip or rotate. In another such embodiment, the gaming system associates certain multiple sided symbols with a duration or quantity which those symbols remain in a symbol display position grid. In this embodiment, if such symbols are generated in a symbol display position and such symbols form part of a winning symbol combination, then as long as the associated duration or quantity has not expired, such symbols are not removed from the symbol display position of the symbol display position grid. In one such embodiment, if such multiple sided symbols remain in a symbol display position grid for a designated duration, the gaming system triggers one or more secondary games.

In one embodiment, the gaming system causes one or more multiple sided symbols to each skip one or more symbol display positions as such multiple sided symbols move from symbol display position to symbol display position. For example, if an empty symbol display position is created in a middle row of a symbol display position grid, rather than shifting the symbol currently displayed in the top row of the symbol display position grid into this empty symbol display position, the gaming system generates another symbol directly into this empty symbol display position of the middle row of the symbol display position grid (i.e., the generated symbol skipped the symbol display position of the top row).

In one embodiment, the gaming system determines whether to flip or rotate a multiple sided symbol based on the symbol display position of the multiple sided symbol. In one such embodiment, the gaming system groups different symbol display positions into different sets wherein when a multiple sided symbol moves from a symbol display position of one set to a symbol display position of another set, the gaming system causes that symbol display position to flip or rotate. For example, the gaming system groups the top two rows of symbol display position in one set (i.e., a back plane) and also groups the bottom two rows of symbol display positions in another set (i.e., a front plane). In this example, the gaming system causes a multiple sided symbol to slide from one symbol display position in the back plane to another symbol display position in the back plane. Additionally, in this example, the gaming system causes a multiple sided symbol to rotate from one symbol display position in the back plane to a symbol display position in the front plane.

In one embodiment, the gaming system causes a multiple sided symbol to flip or rotate along one of a plurality of flip paths. In one such embodiment, the gaming system randomly determines, for each multiple sided symbol or each group of multiple sided symbol, a flip path for such multiple sided symbols to rotate along. In another embodiment, one or more symbol display positions include pegs or spots which determine, at least in part, the flip path for one or more multiple sided symbols. In this embodiment, certain pegs or spots are associated with bumping the multiple sided symbol to another symbol display position, certain pegs or spots are associated with shifting (without rotating) the multiple sided symbol to another symbol display position, and certain pegs or spots are associated with rotating the multiple sided symbol to another symbol display position. In one such embodiment, one or more symbol display positions each include one or more pegs or spots upon the initiation of the cascading multiple sided symbol game. In another such embodiment, the gaming system enables a player to associate one or more pegs with one or more symbol display positions prior to one or more symbol generations of the cascading multiple sided symbol game.

In another embodiment employing one or more pegs or spots, certain pegs or spots are associated with changing the orientation of the multiple sided symbol, such as turning a multiple sided symbol from having a vertical orientation to having a horizontal orientation. For example, the gaming system changes a vertically upright A symbol to a tipped over A symbol. In one such embodiment, different orientations of the same side of a multiple sided symbol are associated with different valuations. In another such embodiment, different orientations of the same side of a multiple sided symbol are associated with different features or characteristics.

In another embodiment employing one or more pegs or spots, certain pegs or spots are associated with changing the orientation of the multiple sided symbol and certain pegs or spots are associated with rotating the multiple sided symbol to another symbol display position. Such an embodiment includes that each two-sided symbol is associated with eight different symbols for award evaluations. For example, if one side of a two-sided symbol includes an A symbol and another side of the two-sided symbol includes a B symbol, then each side of the two-sided symbol may be oriented in four different ways (i.e., up, down, left, and right) for a total of eight distinct symbols. In this example, using a combination of pegs that change the orientation of the multiple sided symbol (i.e., tip symbols around their center while moving them to the left or right as they shift), and pegs which cause symbols to flip sides as they fall, one or more games with eight distinct symbols could play with just one two-sided symbol. In another example utilizing six-sided symbols (i.e., a 3D cube symbol) with six distinct symbols on the six faces of the six-sided symbol, as each of the sides could potentially be displayed in four different orientations (i.e., up, down, left, and right), the single six-sided symbol is associated with a total of twenty-four distinct symbols at any position.

In one embodiment, the gaming system initially masks the symbol on one or more sides (but not each side) of a multiple sided symbol. In this embodiment, while the gaming system rotates or flips such multiple sided symbols as such multiple sided symbols move from symbol display position to symbol display position, the gaming system causes a side of the multiple sided symbol with a displayed or unmasked symbol to be displayed to the player. That is, the gaming system causes a flipping symbol to land with a side having a displayed symbol facing the player. In this embodiment, following the initial generation of such a multiple sided symbol, the gaming system unmasks or otherwise reveals the symbols such that for any subsequent movement and rotation of these multiple sided symbols, the gaming system displays to the player the symbol displayed on each displayed side of such multiple sided symbols. In another embodiment, the gaming system initially displays and then subsequently masks the symbol on one or more sides (but not each side) of a multiple sided symbol. In one such embodiment, after initially displaying and then masking the symbols on one or more sides (but not each side) of a multiple sided symbol, the gaming system enables a player to place an additional wager to unmask a symbol and rotate the multiple sided symbol to display that unmasked symbol.

In another embodiment, one or more sides of one or more multiple sided symbols are associated with an award, such as a value, a modifier (e.g., a multiplier) or a quantity of free spins. In one such embodiment, the gaming system provides an award to a player based on the awards associated with the displayed symbols of the sides of the generated multiple sided symbols. In another such embodiment, the gaming system provides an award to a player based on the awards associated with the displayed symbols of the sides of the generated multiple sided symbols included in a winning symbol combination. In another such embodiment, if a secondary game triggering event occurs, the gaming system triggers a play of a secondary game with one or more features of the secondary game are based on the awards associated with the displayed symbols of the sides of the generated multiple sided symbols.

In another embodiment which includes associating the individual symbols of the individual sides of a multiple sided symbol with one or more awards, the gaming system modifies such awards. In one such embodiment, the awards associated with one or more sides of one or more multiple sided symbols are modified, such as increase, with one or more rotations of that multiple sided symbol. In another such embodiment, the awards associated with one or more sides of one or more multiple sided symbols are modified, such as increase, with one or more movements of that multiple sided symbol.

In another embodiment, one or more sides of one or more multiple sided symbols are associated with a positive outcome and one or more sides of one or more multiple sided symbols are associated with a negative outcome. In this embodiment, which may be employed in association with a tumbling symbol game (as described above) or in association with a non-tumbling symbol game, the gaming system determines any awards to provide based on the quantity and type of symbols associated with positive outcomes compared to the quantity and type of symbols associated with negative outcomes. In one such embodiment, one or more outcomes associated with one or more symbols of one or more sides of such multiple sided symbols are associated with an attribute, such as a relative weighting of that outcome.

In another embodiment, one or more sides or faces of each of the plurality of multiple sided symbols is associated with a characteristic, such as a color, a picture or shape. In this embodiment, the gaming system displays the symbols such that the characteristic (e.g., the color) associated with one or more sides of one or more multiple sided symbols are displayed to the player. In one such embodiment employing characteristics, the gaming system utilizes the characteristics of the symbols to convey information to the player. In another such embodiment employing characteristics, the gaming system utilizes the characteristics of the symbols to provide to the player one or more awards, such as one or more matching characteristic awards. In this embodiment, different characteristics are associated with different awards, such that the award provided to the player is based on which characteristic is matched. For example, if a plurality of the displayed symbol sides of a plurality of the multiple sided symbols generated at a plurality of the symbol display positions are each associated with the same characteristic, such as the same color silver or form a pattern, the gaming system provides to the player the matching characteristic award associated with that characteristic.

In another embodiment, the gaming system enables one or more multiple sided symbols to flip or rotate off of the symbol display position grid. In one such embodiment, if a multiple sided symbol rotates or flips off of the symbol display position grid, the gaming system retains, saves or stores zero, one or more of such symbols. In one such embodiment, the gaming system utilizes such removed and retained symbols in one or more plays of one or more secondary games. In this embodiment, the gaming system first generates one or more symbols in a play of a first game and then further uses such generated (and subsequently stored) symbols in a play of a secondary game to determine one or more awards for the player. In another such embodiment, the gaming system utilizes such removed and retained symbols in a current or subsequent play of the game. In this embodiment, the gaming system first generates one or more symbols in a play of a first game and then further uses such generated (and subsequently stored) symbols in the same play (or another play) of that first game to determine one or more awards for the player. In one such embodiment, the gaming system utilizes such stored symbols to populate one or more additionally formed symbol display positions of a symbol display position grid.

In another embodiment, one or more of the symbols of one or more sides of one or more multiple sided symbols are wild symbols. In one such embodiment, for each rotation of such a multiple sided wild symbol, the gaming system accumulates one or more modifiers, such as multipliers, for the player.

In another embodiment, the gaming system modifies the symbols of one or more sides of one or more multiple sided symbols in association with a rotation or flip of that multiple sided symbol. In one such embodiment, for one or more rotations or flips of a multiple sided symbol, the gaming system causes the symbol on one or more sides to change to a different symbol. In another such embodiment, for one or more rotations or flips of a multiple sided symbol, the gaming system causes the symbol on one or more sides to split into a plurality of symbols.

In another embodiment, the gaming system employs one or more multiple sided symbols in association with a respin feature. In one such embodiment, the gaming system initially generates a plurality of multiple sided symbols in a plurality of symbol display positions as described herein. In this embodiment, following the initial generation of the plurality of multiple sided symbols, the gaming system enables the player to accept the generated multiple sided symbols or rotate the generated multiple sided symbols. If the player accepts the generated multiple sided symbols, the gaming system proceeds with evaluating the generated symbols as described above. On the other hand, if the player elects to rotate the generated multiple sided symbols, the gaming system flips or rotates the symbol display position grip to display the symbols on the opposite sides of each generated multiple sided symbol. It should be appreciated that unlike certain known respin features which include a blind respin of the reels (i.e., the player does not know which symbols will be generated on the respin), in this respin feature, because the player has seen certain of the symbols on the opposite sides of the multiple sided symbols (during such multiple sided symbols initial rotation into the symbol display positions), such a respin features includes a known (or semi-known) respin.

In different embodiments, the awards associated with one or more symbols or winning symbol combinations include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on the internet.

In one embodiment, the gaming system causes at least one display device of at least one electronic gaming machine to display the cascading multiple sided symbol game. In another embodiment, in addition or in alternative to each electronic gaming machine displaying the cascading multiple sided symbol game, the gaming system causes one or more community or overhead display devices to display part or all of the cascading multiple sided symbol game to one or more other players or bystanders either at a gaming establishment or viewing over a network, such as the internet. In another embodiment, in addition or in alternative to each electronic gaming machine displaying the cascading multiple sided symbol game, the gaming system causes one or more internet sites to each display the cascading multiple sided symbol game such that a player is enabled to log on from a personal web browser. In another such embodiment, the gaming system enables the player to play one or more games on one device while viewing the cascading multiple sided symbol game from another device, such as a desktop or laptop computer.

In one embodiment, as described above, a cascading multiple sided symbol game is a primary or base wagering game. In this embodiment, upon a placement of a wager by a player, the gaming system triggers a play of the cascading multiple sided symbol game.

In another embodiment, the cascading multiple sided symbol game is a secondary or bonus game which is triggered in response to an occurrence of a cascading multiple sided symbol game triggering event. In one such embodiment, a cascading multiple sided symbol game triggering event occurs, based on an outcome associated with one or more plays of any primary game and/or an outcome associated with one or more plays of any secondary game of the gaming devices in the gaming system. In one embodiment, such determinations are symbol driven based on the generation of one or more designated symbols or symbol combinations. In various embodiments, a generation of a designated symbol for sub-symbol) or a designated set of symbols (or sub-symbols) over one or more plays of a primary game causes a cascading multiple sided symbol game triggering event to occur.

In another embodiment, the gaming system does not provide any apparent reasons to the players for a cascading multiple sided symbol game triggering event to occur. In these embodiments, such determinations are not triggered by an event in a primary game or based specifically on any of the plays of any primary game or on any of the plays of any secondary game of the gaming devices in the system. That is, these events occur without any explanation or alternatively with simple explanations.

In one embodiment, a cascading multiple sided symbol game triggering event occurs, based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the bonus threshold coin-in amount, the gaming system causes one or more of such events or conditions to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, a cascading multiple sided symbol game triggering event occurs, based on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the players primary game wager, determined based on time (such as the time of day) or determined based on any other suitable method or criteria.

In another alternative embodiment, a cascading multiple sided symbol game triggering event occurs, based on a predefined variable reaching a defined parameter threshold. For example, when the 500,000$^{th}$ player has played a gaming device of the gaming system (ascertained from a player tracking system), one or more of such events or conditions occur. In different embodiments, the predefined parameter thresholds include a length of time, a length of time after a certain dollar amount is hit, a wager level threshold for a specific device (which gaming device is the first to contribute $250,000), a number of gaming devices active, or any other parameter that defines a suitable threshold.

In another alternative embodiment, a cascading multiple sided symbol game triggering event occurs, based on a quantity of games played. In this embodiment, a quantity of games played is set for when one or more of such events or conditions will occur. In one embodiment, such a set quantity of games played is based on historic data.

In another alternative embodiment, a cascading multiple sided symbol game triggering event occurs, based on time. In this embodiment, a time is set for when one or more of such events or conditions will occur. In one embodiment, such a set time is based on historic data.

In another alternative embodiment, a cascading multiple sided symbol game triggering event occurs, based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming device. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, a cascading multiple sided symbol game triggering event occurs, based on a system determination, including one or more random selections by the central controller. In one embodiment, as described above, the central controller tracks all active gaming devices and the wagers they placed. In one such embodiment, based on the gaming device's state as well as one or more wager pools associated with the gaming device, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, a cascading multiple sided symbol game triggering event occurs, based on a determination of if any numbers allotted to a gaming device match a randomly selected number. In this embodiment, upon or prior to each play of each gaming device, a gaming device selects a random number from a range of numbers and during each primary game, the gaming device allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a cascading multiple sided symbol game triggering event to occur may be implemented in accordance with the gaming system and method disclosed herein.

It should be appreciated that any of the above-described cascading multiple sided symbol game triggering events may be combined in one or more different embodiments.

Alternative Embodiments

It should be appreciated that in different embodiments, one or more of:

i. a shape or configuration of each symbol display position grid;
ii. a quantity of rows in each symbol display position grid;
iii. a quantity of columns in each symbol display position grid;
iv. which displayed sides or faces of which multiple sided symbols are evaluated to determine any awards;
v. which individual symbols are associated with which sides of a multiple sided symbol;
vi. a quantity of sides of one or more multiple sided symbols;
vii. which symbols are shifted;
viii. which symbol retain their original positioning;
ix. a determination of if a multiple sided symbol will rotate or not rotate;
x. a determination of if each of a plurality of multiple sided symbols will rotate or not rotate;
xi. a direction of rotation of each multiple sided symbol;
xii. a quantity of rotations within a single symbol display position of each multiple sided symbol;
xiii. a quantity of symbol display positions each multiple sided symbol will rotate into;
xiv. a quantity of symbol display position grids;
xv. a quantity of symbol display positions in each symbol display position grid;
xvi. which symbols are removed from which symbol display position grids;
xvii. a quantity of symbols removed from any symbol display position grids;
xviii. the direction of any shifting of any symbols;
xix. which symbols are available to be generated in each symbol display position grid;
xx. a duration of time a designated symbol will remain at one of the symbol display positions;
xxi. a quantity of winning symbols combinations which a designated symbol will remain at one of the symbol display positions;

xxii. a quantity of symbol shifts a designated symbol will remain at one of the symbol display positions;

xxiii. a quantity of games played in which a designated symbol will remain at one of the symbol display positions;

xxiv. a quantity of designated symbols generated;

xxv. a determination of if one or more symbols skip one or more symbol display positions;

xxvi. a determination of if one or more symbols rotate in place (i.e., rotate without moving symbol display positions);

xxvii. which symbols are associated with which characteristics;

xxviii. which sides of which multiple sided symbols are associated with which characteristics;

xxix. a determination of whether to enable a player to make any inputs to hold any symbols;

xxx. a quantity of stored symbols utilized to compare the generated symbols from a current play of the game to determine any awards for player;

xxxi. which stored symbols from which previous plays of the game are utilized to compare the generated symbols from the current play of the game to determine any awards for the player; and xxxii. any determination disclosed herein;

is/are predetermined, randomly determined, randomly determined based on one or more weighted percentages, determined based on a generated symbol or symbol combination, determined based on a random determination by the central controller, determined based on a random determination at the gaming system, determined based on at least one play of at least one game, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
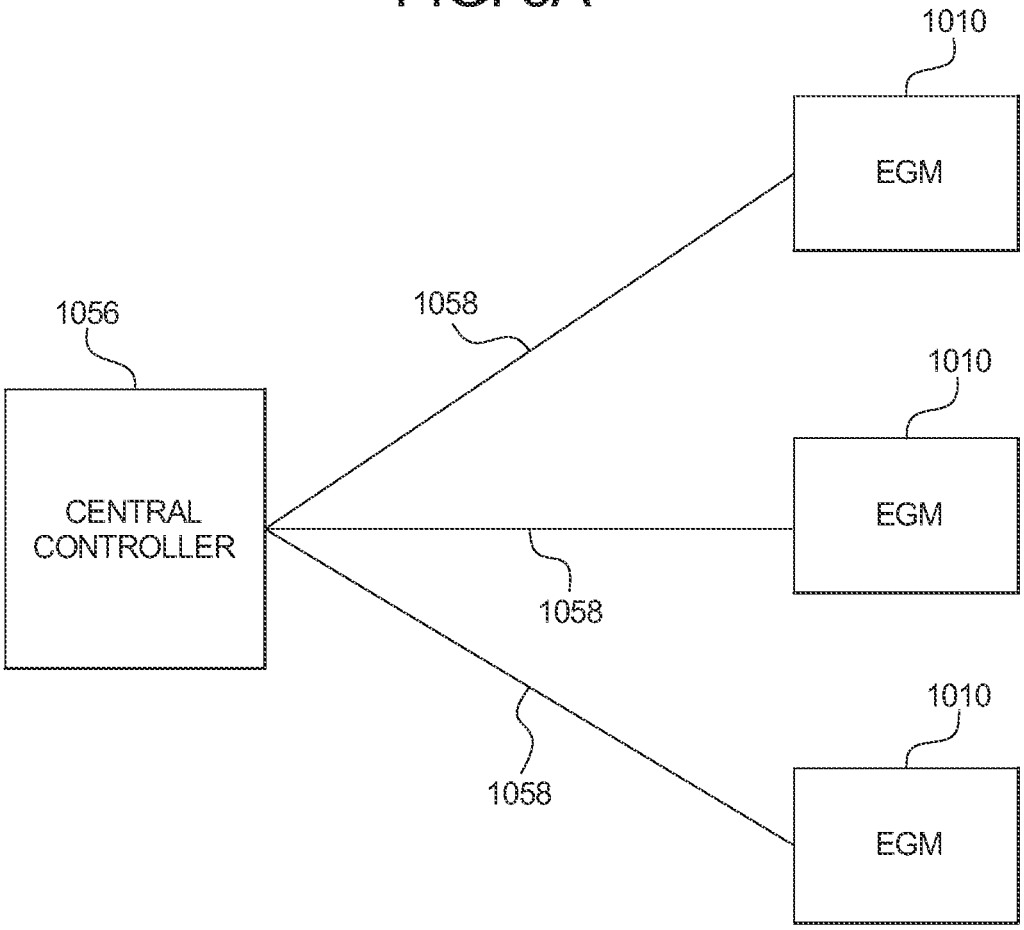
FIG. 3A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
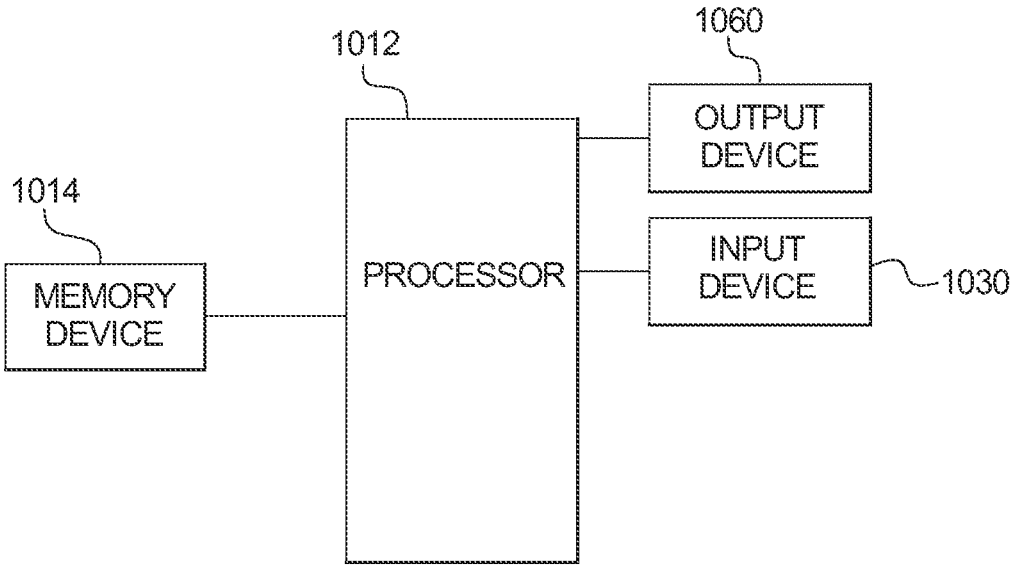
FIG. 3B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
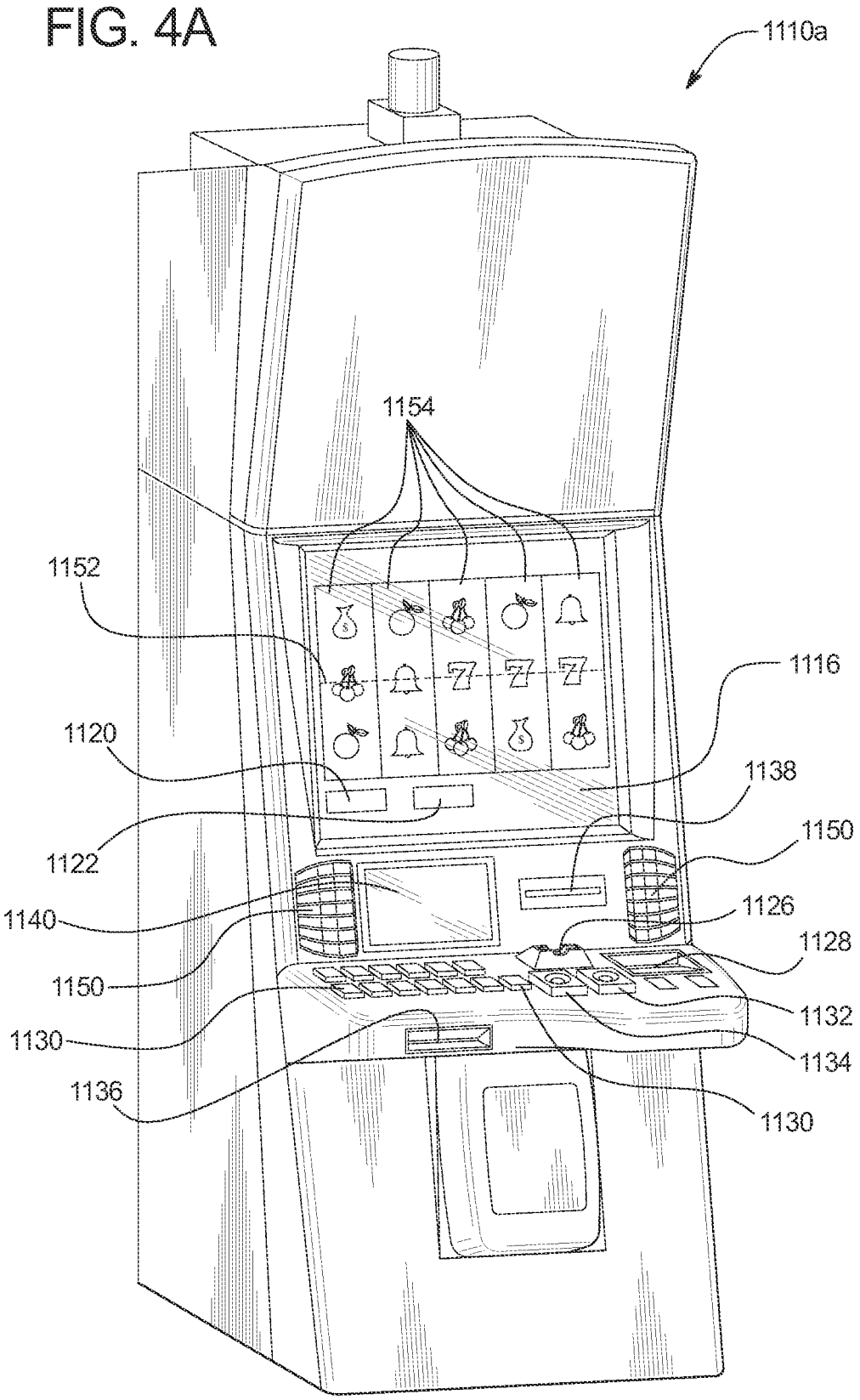
FIGS. 4A and 4B are perspective views of example alternative embodiments of the gaming system disclosed herein.
Figure 4B:
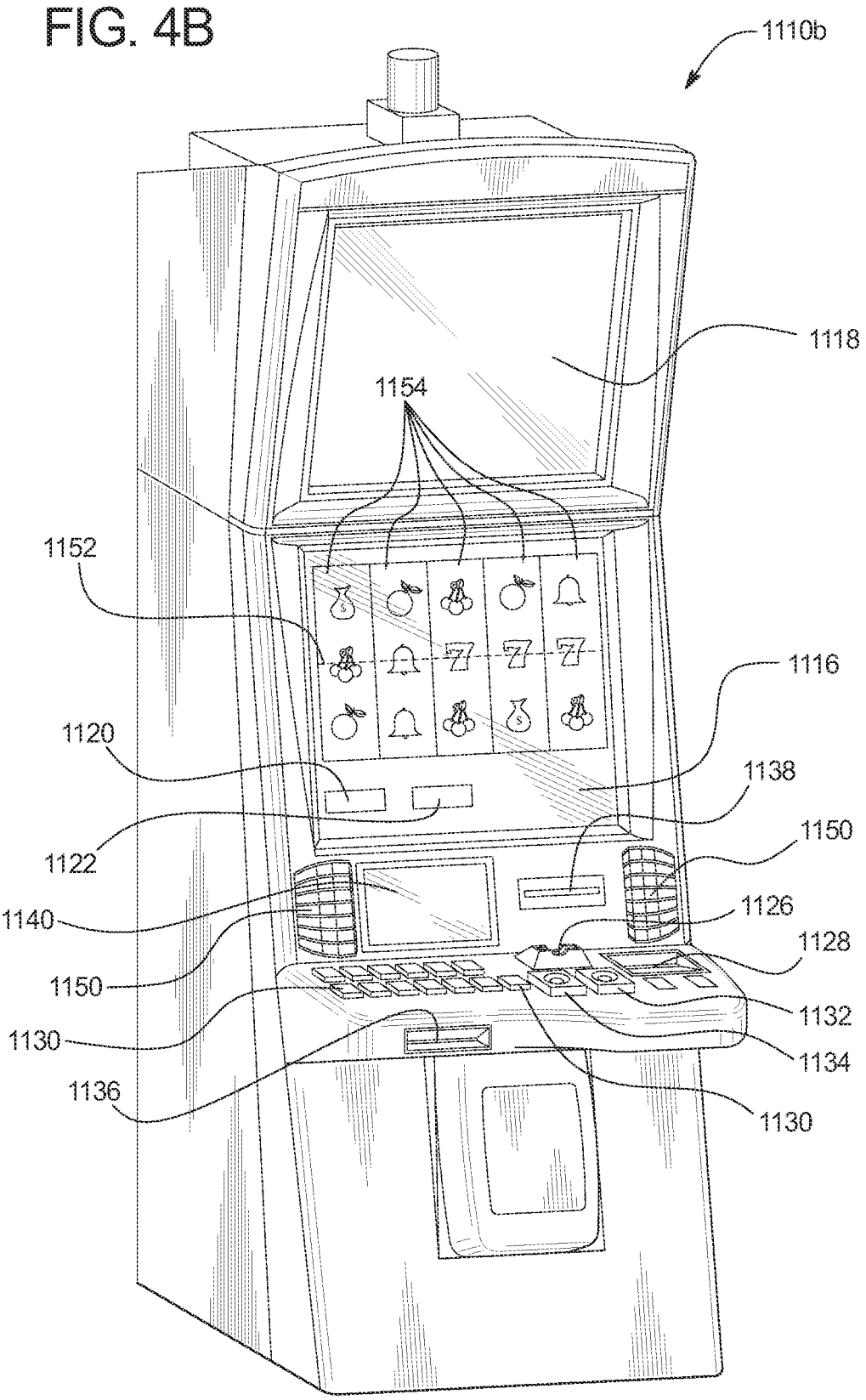

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player: and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electronic gaming machine comprising:

a housing;

at least one video display device supported by the housing;

a plurality of input devices supported by the housing, said plurality of input devices including a payment acceptor;

at least one processor; and at least one memory device which stores a plurality of instructions, which when executed by the at least one processor, cause the at least one processor to:

(a) responsive to a physical item which indicates a monetary value being received via the payment acceptor, cause an increase of a credit balance based, at least in part, on the monetary value of the received physical item, wherein said physical item is selected from the group consisting of: a ticket associated with the monetary value and a unit of currency;

(b) after causing the increase of the credit balance based, at least in part, on the monetary value indicated by the received physical item, for a play of an initiated game:

(i) determine one of a plurality of different symbols at each of a plurality of symbol display positions, wherein:

(A) the plurality of symbol display positions form at least three columns and at least three rows including a first row, a second row positioned adjacent to the first row and a third row positioned adjacent to the second row, (B) at least one of the symbols is a multiple sided symbol with a distinct symbol on each of a plurality of sides of said multiple sided symbol, and (C) for each multiple sided symbol, the distinct symbol on each of the plurality of sides of said multiple sided symbol is predetermined prior to the play of the initiated game, (ii) cause the at least one video display device to display the determined symbols, wherein for each determined multiple sided symbol, the distinct symbol of a first side of said determined multiple sided symbol is displayed, (iii) thereafter, determine if any of the displayed symbols form any winning symbol combinations, wherein for each determined multiple sided symbol, the distinct symbol of one of the sides of said multiple sided symbol currently displayed is evaluated to determine if any winning symbol combinations are formed, and (iv) responsive to a plurality of the displayed symbols forming at least one winning symbol combination:

(A) cause the at least one video display device to display an award for each displayed winning symbol combination, wherein the credit balance is increasable based on the displayed award for each displayed winning symbol combination, (B) cause the at least one video display device to display a removal at least one displayed symbol from at least one displayed winning symbol combination, (C) for each of any symbols removed from the first row of the symbol display positions, cause the at least one video display device to display a repositioning of at least one of the displayed symbols to another one of the symbol display positions to create at least one empty symbol display position, wherein, based on a first player strategy input received, a repositioning of at least one of any multiple sided symbols not part of the at least one formed winning symbol combination from one of the symbol display positions to another one of the symbol display positions includes at least partially rotating said multiple sided symbol at least once to display another one of the distinct symbols of one of the sides of said multiple sided symbol, (D) for each of any multiple sided symbols not removed from the first row of the symbol display positions, not reposition any of the displayed symbols in association with that multiple sided symbol not being removed from the first row of the symbol display positions, (E) for each of any symbols removed from the second row of the symbol display positions, cause the at least one video display device to display a repositioning of at least one of the displayed symbols to another one of the symbol display positions to create at least one empty symbol display position, wherein, based on a second player strategy input received, a repositioning of at least one of any multiple sided symbols not part of the at least one formed winning symbol combination from one of the symbol display positions to another one of the symbol display positions includes at least partially rotating said multiple sided symbol at least once to display another one of the distinct symbols of one of the sides of said multiple sided symbol, (F) for each of any multiple sided symbols not removed from the second row of the symbol display positions, not reposition any of the displayed symbols in association with that multiple sided symbol not being removed from the second row of the symbol display positions, (G) for each created empty symbol display position, cause the at least one video display device to display one of the plurality of symbols, and (H) repeat (b)(iii) to (b)(iv) until no winning symbol combinations are displayed; and (c) responsive to a cashout input being received, cause an initiation of any payout associated with the credit balance.

2. The electronic gaming machine of claim 1, wherein when executed by the at least one processor, the plurality of instructions cause the at least one processor, for each rotated multiple sided symbol, to: (i) cause the at least one video display device to display the distinct symbol of the first side of said multiple sided symbol if said multiple sided symbol is rotated an even quantity of rotations, and (ii) cause the at least one video display device to display the distinct symbol of the second side of said multiple sided symbol if said multiple sided symbol is rotated an odd quantity of rotations.

3. The electronic gaming machine of claim 1, wherein when executed by the at least one processor, the plurality of instructions cause the at least one processor to, in association with the display of the determined symbols of (b)(ii), at least partially rotate at least one of the determined multiple sided symbols at least once.

4. The electronic gaming machine of claim 1, wherein when executed by the at least one processor, the plurality of instructions cause the at least one processor to at least partially rotate at least one non-repositioned multiple sided symbol at least once to display one of the distinct symbols of one of the sides of said multiple sided symbol.

5. The electronic gaming machine of claim 1, wherein at least one of the determined symbols is a multiple dimension multiple sided symbol including at least three symbol sides.

6. The electronic gaming machine of claim 5, wherein when executed by the at least one processor, the plurality of instructions cause the at least one processor to, for each rotated multiple dimension multiple sided symbol, at least partially rotate said multiple dimension multiple sided symbol at least once to display one of: the distinct symbol of the first side of said multiple dimension multiple sided symbol, the distinct symbol of the second side of said multiple dimension multiple sided symbol and the distinct symbol of a third side of said multiple dimension multiple sided symbol.

7. The electronic gaming machine of claim 1, wherein when executed by the at least one processor, the plurality of instructions cause the at least one processor to, for each repositioned multiple sided symbol removed from the first row of the symbol display positions, at least partially rotate said repositioned multiple sided symbol at least once to display one of the distinct symbols of one of the sides of said multiple sided symbol.

8. The electronic gaming machine of claim 1, wherein when executed by the at least one processor, the plurality of instructions cause the at least one processor to, for each repositioned multiple sided symbol removed from the second row of the symbol display positions, at least partially rotate said repositioned multiple sided symbol at least once to display one of the distinct symbols of one of the sides of said multiple sided symbol.

9. The electronic gaming machine of claim 1, wherein the award is selected from the group consisting of: a quantity of monetary credits, a quantity of non-monetary credits, a quantity of promotional credits, a quantity of player tracking points, a progressive award, a modifier, a quantity of free plays of the game, a quantity of plays of at least one non-wagering game, at least one lottery based award, a wager match for at least one play of the game, an increase in an average expected payback percentage of the game, at least one comp, a quantity of credits usable for an online play of an online game, a quantity of virtual goods and an access code usable to unlock content on an internet.

10. A method of operating an electronic gaming machine, said method comprising:

(a) responsive to a physical item which indicates a monetary value being received via a payment acceptor, increasing a credit balance based, at least in part, on the monetary value of the received physical item, wherein said physical item is selected from the group consisting of: a ticket associated with the monetary value and a unit of currency;

(b) after increasing the credit balance based, at least in part, on the monetary value indicated by the received physical item, for a play of an initiated game:

(i) determining, by at least one processor, one of a plurality of different symbols at each of a plurality of symbol display positions, wherein:

(A) the plurality of symbol display positions form at least three columns and at least three rows including a first row, a second row positioned adjacent to the first row and a third row positioned adjacent to the second row, (B) at least one of the symbols is a multiple sided symbol with a distinct symbol on each of a plurality of sides of said multiple sided symbol, and (C) for each multiple sided symbol, the distinct symbol on each of the plurality of sides of said multiple sided symbol is predetermined prior to the play of the initiated game, (ii) displaying, by at least one video display device, the determined symbols, wherein for each determined multiple sided symbol, the distinct symbol of a first side of said determined multiple sided symbol is displayed, (iii) thereafter, determining, by the at least one processor, if any of the displayed symbols form any winning symbol combinations, wherein for each determined multiple sided symbol, the distinct symbol of one of the sides of said multiple sided symbol currently displayed is evaluated to determine if any winning symbol combinations are formed, and (iv) responsive to a plurality of the displayed symbols forming at least one winning symbol combination:

(A) displaying, by the at least one video display device, an award for each displayed winning symbol combination, wherein the credit balance is increasable based on the displayed award for each displayed winning symbol combination, (B) displaying, by the at least one video display device, a removal of at least one displayed symbol from at least one displayed winning symbol combination, (C) for each of any symbols removed from the first row of the symbol display positions, displaying, by the at least one video display device, a repositioning of at least one of the displayed symbols to another one of the symbol display positions to create at least one empty symbol display position, wherein, based on a first player strategy input received, a repositioning of at least one of any multiple sided symbols not part of the at least one formed winning symbol combination from one of the symbol display positions to another one of the symbol display positions includes displaying, by the at least one video display device, a partial rotation of said multiple sided symbol at least once to display another one of the distinct symbols of one of the sides of said multiple sided symbol, (D) for each of any multiple sided symbols not removed from the first row of the symbol display positions, not displaying any repositioning of any of the displayed symbols in association with that multiple sided symbol not being removed from the first row of the symbol display positions, (E) for each of any symbols removed from the second row of the symbol display positions, displaying, by the at least one video display device, a repositioning of at least one of the displayed symbols to another one of the symbol display positions to create at least one empty symbol display position, wherein, based on a second player strategy input received, a repositioning of at least one of any multiple sided symbols not part of the at least one formed winning symbol combination from one of the symbol display positions to another one of the symbol display positions includes displaying, by the at least one video display device, a partial rotation of said multiple sided symbol at least once to display another one of the distinct symbols of one of the sides of said multiple sided symbol, (F) for each of any multiple sided symbols not removed from the second row of the symbol display positions, not displaying any repositioning of any of the displayed symbols in association with that multiple sided symbol not being removed from the second row of the symbol display positions, (G) for each created empty symbol display position, displaying, by the at least one video display device, one of the plurality of symbols, (H) repeating (b)(iii) to (b)(iv) until no winning symbol combinations are displayed; and (c) responsive to a cashout input being received, causing an initiation of any payout associated with the credit balance.

11. The method of claim 10, which includes, for each rotated multiple sided symbol: (i) displaying, by the at least one video display device, the distinct symbol of the first side of said multiple sided symbol if said multiple sided symbol is rotated an even quantity of rotations, and (ii) displaying, by the at least one video display device, the distinct symbol of the second side of said multiple sided symbol if said multiple sided symbol is rotated an odd quantity of rotations.

12. The method of claim 10, further comprising displaying, by the at least one video display device, a partial rotation of at least one of the determined multiple sided symbols at least once in association with the display of the determined symbols of (b)(ii).

13. The method of claim 10, further comprising displaying, by the at least one video display device, a partial rotation of at least one non-repositioned multiple sided symbol at least once to display one of the distinct symbols of one of the sides of said multiple sided symbol.

14. The method of claim 10, wherein at least one of the determined symbols is a multiple dimension multiple sided symbol including at least three symbol sides.

15. The method of claim 14, further comprising, for each rotated multiple dimension multiple sided symbol, displaying, by the at least one video display device, a partial rotation of said multiple dimension multiple sided symbol at least once to display one of: the distinct symbol of the first side of said multiple dimension multiple sided symbol, the distinct symbol of the second side of said multiple dimension multiple sided symbol and the distinct symbol of a third side of said multiple dimension multiple sided symbol.

16. The method of claim 10, further comprising, for each repositioned multiple sided symbol removed from the first row of the symbol display positions, displaying, by the at least one video display device, a partial rotation of said repositioned multiple sided symbol at least once to display one of the distinct symbols of one of the sides of said multiple sided symbol.

17. The method of claim 10, further comprising, for each repositioned multiple sided symbol removed from the second row of the symbol display positions, displaying, by the at least one video display device, a partial rotation of said repositioned multiple sided symbol at least once to display one of the distinct symbols of one of the sides of said multiple sided symbol.

18. The method of claim 10, wherein the award is selected from the group consisting of: a quantity of monetary credits, a quantity of non-monetary credits, a quantity of promotional credits, a quantity of player tracking points, a progressive award, a modifier, a quantity of free plays of the game, a quantity of plays of at least one non-wagering game, at least one lottery based award, a wager match for at least one play of the game, an increase in an average expected payback percentage of the game, at least one comp, a quantity of credits usable for an online play of an online game, a quantity of virtual goods and an access code usable to unlock content on an internet.

* * * * *